US011668090B2

(12) United States Patent
Grise et al.

(10) Patent No.: US 11,668,090 B2
(45) Date of Patent: Jun. 6, 2023

(54) WINDOW WALL SYSTEM

(71) Applicant: A.&D. PREVOST INC., Richelieu (CA)

(72) Inventors: Jocelyn Grise, Richelieu (CA); Benoit Gauthier, St-Cyrille de Wendover (CA); Martin Roy, St-Jean sur Richelieu (CA)

(73) Assignee: A. & D. PREVOST INC., Richelieu (CA)

( * ) Notice: Subject to any disclaimer, the term of this patent is extended or adjusted under 35 U.S.C. 154(b) by 0 days.

(21) Appl. No.: 17/088,436

(22) Filed: Nov. 3, 2020

(65) Prior Publication Data

US 2021/0140173 A1 May 13, 2021

Related U.S. Application Data

(60) Provisional application No. 62/933,635, filed on Nov. 11, 2019.

(51) Int. Cl.
*E04H 1/00* (2006.01)
*E04B 2/96* (2006.01)
(Continued)

(52) U.S. Cl.
CPC ..... *E04B 2/965* (2013.01); *E04B 1/40* (2013.01); *E04B 1/665* (2013.01); *E04B 2001/405* (2013.01)

(58) Field of Classification Search
CPC ..... E04B 2/965; E04B 1/40
See application file for complete search history.

(56) References Cited

U.S. PATENT DOCUMENTS 3,052,330 A 9/1962 Hammitt
3,084,483 A 4/1963 Cipriani et al.
(Continued)

FOREIGN PATENT DOCUMENTS

EP 1039059 A2 9/2000
GB 1417393 A 12/1975

OTHER PUBLICATIONS

Kawneer, Curtain Wall Systems, Architectural Aluminium Glazing Systems, Apr. 2019.

(Continued)

*Primary Examiner* — Basil S Katcheves
(74) *Attorney, Agent, or Firm* — BCF LLP

(57) ABSTRACT

A window wall system includes a plurality of window wall modules for forming at least in part a facade of a building. Each window wall module is connected between two consecutive concrete slabs of the building and includes a bottom rail, a top rail, two vertical mullions, and a window panel. The system also includes a plurality of anchoring brackets for connecting the bottom rail of each window wall module to a respective one of the concrete slabs, and a plurality of preformed sealing membranes. Each anchoring bracket is configured to be affixed to a top surface of the respective one of the concrete slabs. Each sealing membrane sealingly engages the bottom rail of a corresponding window wall module. Each sealing membrane is interlocked with a respective one of the anchoring brackets to retain the sealing membrane in place. Each sealing membrane is made of an elastomeric material.

10 Claims, 27 Drawing Sheets

(51) Int. Cl.

| | |
|---|---|
| ***E04B 1/41*** | (2006.01) |
| ***E04B 1/66*** | (2006.01) |
| *E04B 1/38* | (2006.01) |

(56) References Cited

U.S. PATENT DOCUMENTS

| | | | | |
|---|---|---|---|---|
| 3,715,848 | A * | 2/1973 | Jordan | E04B 1/62 52/235 |
| 4,614,069 | A | 9/1986 | Tanikawa et al. | |
| 5,063,718 | A * | 11/1991 | Nonis | E04B 2/90 52/235 |
| 6,158,182 | A | 12/2000 | Biebuyck | |
| 6,591,562 | B2 * | 7/2003 | Ting | E04B 2/96 52/235 |
| 6,598,361 | B2 * | 7/2003 | Ting | E04B 2/96 52/235 |
| 6,993,873 | B2 | 2/2006 | Biebuyck et al. | |
| 7,827,746 | B2 | 11/2010 | Speck | |
| 8,413,403 | B2 | 4/2013 | Walker et al. | |
| 8,991,221 | B2 | 3/2015 | Baker | |
| 9,243,442 | B2 | 1/2016 | Weinryb et al. | |
| 9,752,319 | B1 * | 9/2017 | LeVan | E04B 2/885 |
| 2006/0016133 | A1 * | 1/2006 | Speck | E04B 2/96 52/79.1 |
| 2007/0022682 | A1 | 2/2007 | Morgenegg et al. | |
| 2009/0199498 | A1 * | 8/2009 | Ting | E04B 2/90 52/235 |
| 2011/0258945 | A1 * | 10/2011 | Arbour | F24D 3/127 52/173.3 |
| 2013/0104472 | A1 * | 5/2013 | Carolan | E04F 13/0819 52/204.1 |
| 2014/0331579 | A1 * | 11/2014 | Evensen | E04B 2/96 52/204.593 |
| 2015/0275512 | A1 * | 10/2015 | Bertoldini | E04B 2/90 52/236.6 |
| 2017/0070185 | A1 * | 3/2017 | Ting | E06B 1/6007 |
| 2018/0305921 | A1 * | 10/2018 | Margalit | E06B 1/702 |
| 2018/0334799 | A1 * | 11/2018 | Andresen | E04B 1/7616 |

OTHER PUBLICATIONS

Farmer, M.C. et al., Lock-Strip Glazing Gasket Curtain Walls—How old is too old?, Building Evelope Technology Symposium, Oct. 2014.

Oldcastle Building Envelope, Curtain Wall Product Selector, Sep. 2019.

Libart, Vertical Retraction 101—PanoraView, Sep. 2019.

Dezeen, Vertically sliding walls oepn Bergmeisterwolf's Italian villa extension to the garden, published on Jul. 11, 2017, https://www.youtube.com/watch?v=xSXeiUrtXEA.

* cited by examiner

WINDOW WALL SYSTEM

CROSS-REFERENCE

The present application claims priority from U.S. Provisional Patent Application No. 62/933,635, filed Nov. 11, 2019, the entirety of which is incorporated by reference herein.

FIELD OF TECHNOLOGY

The present technology relates to window wall systems for buildings.

BACKGROUND

Modern buildings often integrate a glazed exterior building envelope system to form the exterior glazed walls of the building. There are two predominant types of such systems: window wall systems and curtain wall systems. Both types of systems include various panel-like modules that are connected to the concrete slabs of a building. In curtain wall systems, the curtain wall modules are positioned proud of the concrete slabs and are anchored to the peripheral surfaces of the concrete slabs, thus hanging like curtains from the structure of the building. On the other hand, in window wall systems, the window wall modules are disposed between the concrete slabs and are anchored to the top and bottom surfaces of the concrete slabs. Curtain wall systems have some advantageous characteristics, namely being easier to seal due to the exterior position of the curtain wall modules relative to the concrete slabs of the building. However, these advantages come at a cost since the installation of a curtain wall system is also more labor intensive and therefore more expensive, notably since the curtain wall modules are typically installed from outside due their exterior position, thus requiring a crane or other material handling machinery to place the curtain wall modules in position.

In this context, it will be understood that it is important that a window wall system be properly sealed so as to prevent water and air from penetrating the window wall system and into the interior of the building. To that end, during installation of a window wall system, a silicon caulking is typically applied between the bottom ends of the window wall modules and the concrete slabs to form a seal therebetween. However, this solution can be ineffective as the caulking can have irregularities resulting from an imperfect application thereof, which can allow the ingress of water and air therethrough. It is also known to wrap a bitumen waterproofing sheet between the vertically-adjacent window wall modules and a corresponding concrete slab, around the periphery of a concrete slab, to shield the concrete slab from moisture having seeped through the window wall modules. However, installing this type of sheet can be a complicated and time-consuming process. In addition, the number of components of conventional window wall systems contributes to their complexity and makes the window wall system more difficult to seal properly.

Furthermore, a difficulty can arise in the design of window wall systems in that there may be some deflection in the structure of the building which can cause a poor fit of the window wall modules between the concrete slabs. In addition, the concrete slabs can vary in thickness in accordance with their tolerances, thus exacerbating the problem.

In view of the foregoing, there is a need for a window wall system that addresses at least some of these drawbacks.

SUMMARY

It is an object of the present technology to ameliorate at least some of the inconveniences present in the prior art.

According to an aspect of the present technology, there is provided a window wall system for a building. The building has a plurality of vertically spaced concrete slabs forming respective floors of the building. The window wall system includes a plurality of window wall modules for forming at least in part a facade of the building, each of the window wall modules of the plurality of window wall modules being connected between two consecutive ones of the concrete slabs. Each of the window wall modules includes: a bottom rail configured to be connected to a bottom one of the two consecutive concrete slabs; a top rail extending generally parallel to the bottom rail; two vertical mullions connected between the bottom and top rails; and a window panel retained between the bottom rail, the top rail and the two vertical mullions. The window wall system also includes a plurality of anchoring brackets for connecting the bottom rail of each window wall module to a respective one of the concrete slabs, each anchoring bracket being configured to be affixed to a top surface of the respective one of the concrete slabs; and a plurality of preformed sealing membranes, each sealing membrane sealingly engaging the bottom rail of a corresponding window wall module. Each sealing membrane is interlocked with a respective one of the anchoring brackets to retain the sealing membrane in place. Each sealing membrane is made of an elastomeric material.

In some embodiments, the building has at least one balcony area. Each of the at least one balcony area is formed in part by a given one of the concrete slabs having: a stepped portion having a top surface; and an upper portion at least partly surrounding the stepped portion. The upper portion has a top surface disposed vertically higher than the top surface of the stepped portion. At least one of the anchoring brackets is configured to be affixed to the top surface of the upper portion of each given one of the concrete slabs near an edge of the stepped portion thereof. The plurality of sealing membranes includes at least one balcony sealing membrane configured to prevent passage of fluid between (i) the bottom rail of at least one of the window wall modules connected to the at least one of the anchoring brackets and (ii) the given one of the concrete slabs. Each of the at least one balcony sealing membrane being interlocked with the at least one of the anchoring brackets, part of each of the at least one balcony sealing membrane being configured to be bent about an edge of the upper portion of the given one of the concrete slabs and fastened to a vertical surface of the given one of the concrete slabs extending between the stepped portion and the upper portion.

In some embodiments, each of the at least one balcony sealing membrane is configured to be adhered to the given one of the concrete slabs.

In some embodiments, the window wall system also includes a plurality of bypass modules for forming at least in part the facade of the building. Each of the bypass modules is connected between the top rail of a first one of the window wall modules and a bottom rail of a second one of the window wall modules disposed vertically above the first one of the window wall modules. Each of the bypass modules includes: a bypass body; and a cover member disposed atop the bypass body. The plurality of sealing membranes includes at least one bypass sealing membrane configured to prevent passage of fluid between (i) the bottom rail of at least one of the window wall modules and (ii) the cover member of at least one of the bypass modules. The at least one bypass sealing membrane and the at least one balcony sealing membrane have identical cross-sectional profiles.

In some embodiments, the window wall system also includes a plurality of bypass modules forming at least in part the facade of the building, each of the bypass modules being connected between the top rail of a first one of the window wall modules and a bottom rail of a second one of the window wall modules disposed vertically above the first one of the window wall modules. Each bypass module includes: a bypass body; and a cover member disposed atop the bypass body. The plurality of sealing membranes includes at least one bypass sealing membrane configured to prevent passage of fluid between (i) the bottom rail of at least one of the window wall modules and (ii) the cover member of at least one of the bypass modules.

In some embodiments, each of the bypass sealing membranes has an upper end and a lower end; and the upper end and the lower end of each of the bypass sealing membranes are generally aligned with one another so that the upper end is positioned vertically above the lower end.

In some embodiments, for each of the bypass sealing membranes: the upper end has a first interlocking feature for interlocking the bypass sealing membrane with a corresponding anchoring bracket; and the lower end has a second interlocking feature for interlocking the bypass sealing membrane with a corresponding bypass module.

In some embodiments, each of the sealing membranes has a plurality of legs for engaging a surface of the bottom rail of the respective one of the window wall modules.

In some embodiments, each of the sealing membranes is made of silicone.

In some embodiments, each of the sealing membranes is configured to be distanced from a peripheral edge of a corresponding one of the concrete slabs.

In some embodiments, each of the sealing membranes extends across a width of multiple ones of the window wall modules.

In some embodiments, the window wall system also includes a plurality of foam inserts disposed between laterally-adjacent ones of the window wall modules to prevent entry of fluid therebetween. Each of the foam inserts is pinched at least at two points by the respective vertical mullions of the laterally-adjacent ones of the window wall modules, including a first point and a second point. The second point is closer to an inner face of each of the vertical mullions of the laterally-adjacent ones of the window wall modules than the first point.

In some embodiments, the foam inserts are made of ethylene propylene diene monomer (EPDM) foam.

In some embodiments, the anchoring brackets are elongated members. Each of the anchoring brackets extends across a width of multiple ones of the window wall modules.

In some embodiments, the anchoring brackets are made of aluminum.

According to another aspect of the present technology, there is provided a method for installing a window wall system on a building. The method includes: affixing an anchoring bracket to a top surface of a first concrete slab; affixing part of a preformed sealing membrane to the anchoring bracket, the sealing membrane being made of elastomeric material; engaging a window wall module with the anchoring bracket so that the anchoring bracket retains the window wall module in place, the sealing membrane sealingly engaging a bottom rail of the window wall module to prevent passage of fluid from outside past the window wall module at the bottom rail; and affixing a top portion of the window wall module to a second concrete slab disposed vertically above the first concrete slab.

In some embodiments, the method also includes, prior to affixing the sealing membrane to the anchoring bracket, rolling a length of the sealing membrane in place.

In some embodiments, affixing the preformed sealing membrane to the anchoring bracket includes: inserting an interlocking feature of the preformed sealing membrane into a corresponding membrane-receiving portion of the anchoring bracket.

In some embodiments, affixing the anchoring bracket to the top surface of the concrete slab comprises inserting at least one fastener into the anchoring bracket and into the first concrete slab.

In some embodiments, the method also includes adhering another part of the sealing membrane to the first concrete slab.

In some embodiments, engaging the window wall module with the anchoring bracket includes: inserting a rail-engaging portion of the anchoring bracket into a corresponding recess of a bottom rail of the window wall module, the rail-engaging portion being interlocked with the bottom rail.

In some embodiments, the window wall module is a first window wall module. The method also includes: placing a second window wall module laterally adjacent to the first window wall module; engaging the second window wall module with the anchoring bracket so that the anchoring bracket retains the second window wall module in place, the sealing membrane sealingly engaging a bottom rail of the second window wall module to prevent passage of fluid from outside past the second window wall module at the bottom rail thereof.

In some embodiments, the method also includes, prior to placing the second window wall module laterally adjacent to the first window wall module, placing a foam insert adjacent to a vertical mullion of the first window wall module so that, when the second window wall module is placed, the foam insert is disposed between the first window wall module and the second window wall module so that the foam insert is pinched between respective vertical mullions of the first and second window wall modules at least at two points including a first point and a second point, the second point being closer to an inner face of each of the vertical mullions of the first and second window wall modules than the first point.

In some embodiments, the anchoring bracket is a first anchoring bracket; the sealing membrane is a first sealing membrane; and the method also includes: connecting a bypass module to the window wall module, the bypass module being disposed atop the window wall module; affixing a second anchoring bracket to a top surface of the second concrete slab; and affixing a second preformed sealing membrane to the second anchoring bracket and to the bypass module so that an upper end and a lower end of the second sealing membrane are generally aligned with one another so that the upper end is positioned vertically above the lower end. The second sealing membrane is made of elastomeric material.

In some embodiments, the first sealing membrane and the second sealing membrane are interchangeably usable.

In some embodiments, the first sealing membrane and the second sealing membrane have identical cross-sectional profiles.

According to another aspect of the present technology, there is provided a window wall system for a building. The building has a plurality of vertically spaced concrete slabs forming respective floors of the building. The window wall system includes a plurality of window wall modules for forming at least in part a facade of the building, each of the window wall modules of the plurality of window wall modules being connected between two consecutive ones of the concrete slabs. Each of the window wall modules includes: a bottom rail configured to be connected to a bottom one of the two consecutive concrete slabs; a top rail extending generally parallel to the bottom rail; two vertical mullions connected between the bottom and top rails; and a window panel retained between the bottom rail, the top rail and the two vertical mullions. The window wall system also includes: a plurality of anchoring brackets for connecting the bottom rail of each window wall module to a respective one of the concrete slabs, each anchoring bracket being configured to be affixed to a top surface of the respective one of the concrete slabs; and a plurality of adjustable connectors for connecting a top portion of each window wall module to a corresponding one of the concrete slabs disposed thereover. A vertical position of each window wall module relative to the corresponding one of the concrete slabs being adjustable via at least one of the adjustable connectors.

In some embodiments, the vertical position of each window wall module relative to the corresponding one of the concrete slabs is adjustable within a range spanning between 30 mm and 50 mm.

In some embodiments, the range spans between 35 mm and 45 mm.

In some embodiments, the range spans approximately 38 mm.

In some embodiments, the adjustable connectors are connected to one of the top rail and the vertical mullions of the window wall modules.

In some embodiments, the one of the top and the vertical mullions is the vertical mullions.

In some embodiments, each adjustable connector of the plurality of adjustable connectors includes: an angle bracket having a top portion and a bottom portion extending generally perpendicular to the top portion, the top portion being fastenable to the corresponding one of the concrete slabs, the bottom portion defining at least one slot; and at least one fastener extending through the at least one slot and engaging the top portion of the window wall module.

In some embodiments, at least two of the adjustable connectors are connected to each of the window wall modules.

In some embodiments, the angle bracket is made of steel.

In some embodiments, the window wall system also includes a plurality of casing units for at least partly enclosing therein at least one adjustable connector of the plurality of adjustable connectors. Each casing unit of the plurality of casing units is connected to the top portion of a corresponding window wall module.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
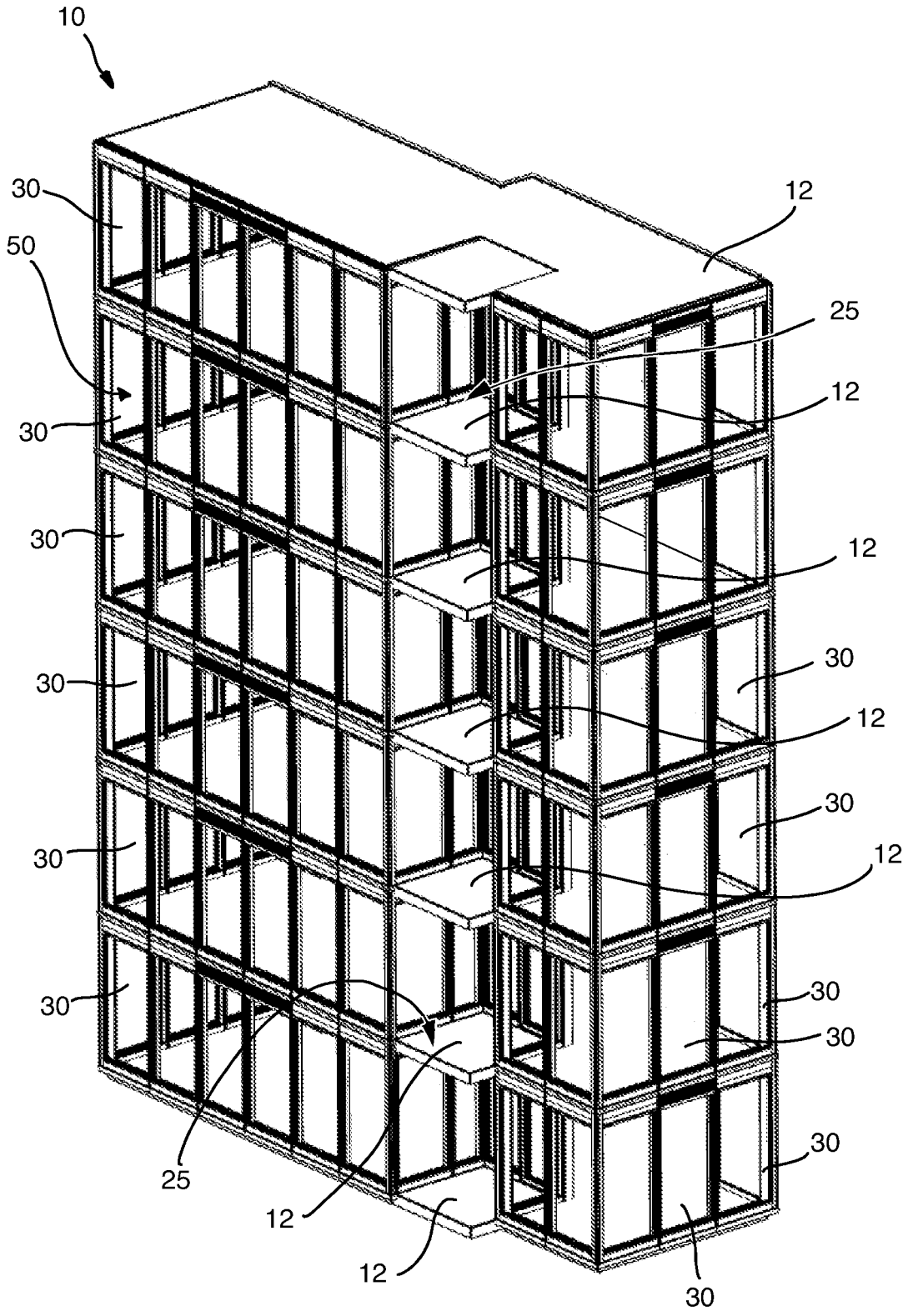
FIG. 1 is a perspective view of a building having a window wall system in accordance with an embodiment of the present technology.
Figure 2:
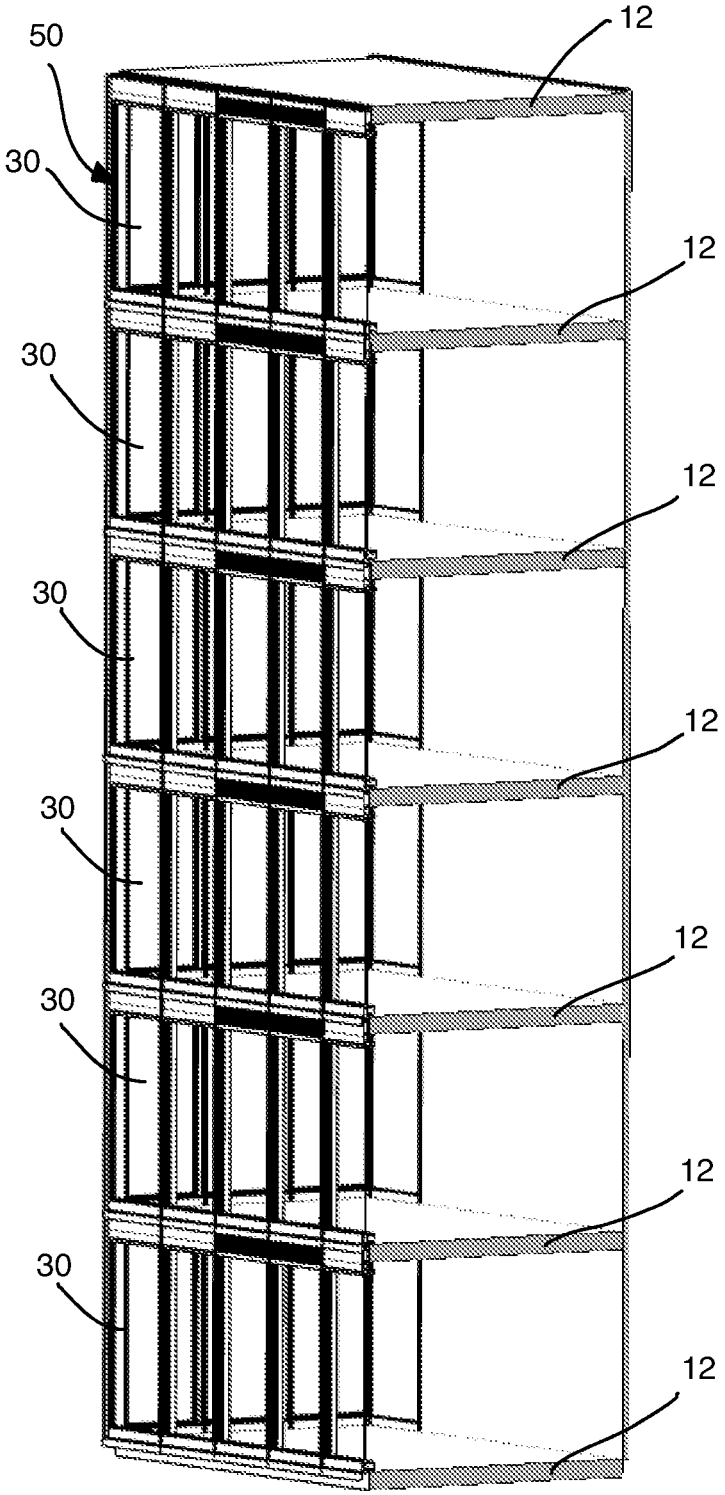
FIG. 2 is a perspective view of a cross-section of the building of FIG. 1.

A building 10 including a window wall system 50 in accordance with an embodiment of the present technology is shown in FIG. 1. The window wall system 50 forms the exterior walls (i.e., a facade) of the building 10, which act as a barrier between the interior of the building 10 and the exterior. As can be seen more clearly in the cross-section of FIG. 2, the building 10 includes a plurality of horizontal concrete slabs 12 that are vertically spaced from one another and that form respective floors of the building 10.

The window wall system 50 includes a plurality of window wall modules 30, each window wall module 30 being connected between two consecutive ones of the slabs 12 such that each window wall module 30 is disposed at least in part between a bottom slab 12 and a top slab 12 and is connected thereto as will be described in detail below. Furthermore, the window wall system 50 also has bypass modules 20 interconnecting two vertically-consecutive ones of the window wall modules 30. Notably, the bypass modules 20 bridge the gap between the window wall modules 30 corresponding to different floors of the building 10.

Figure 3:
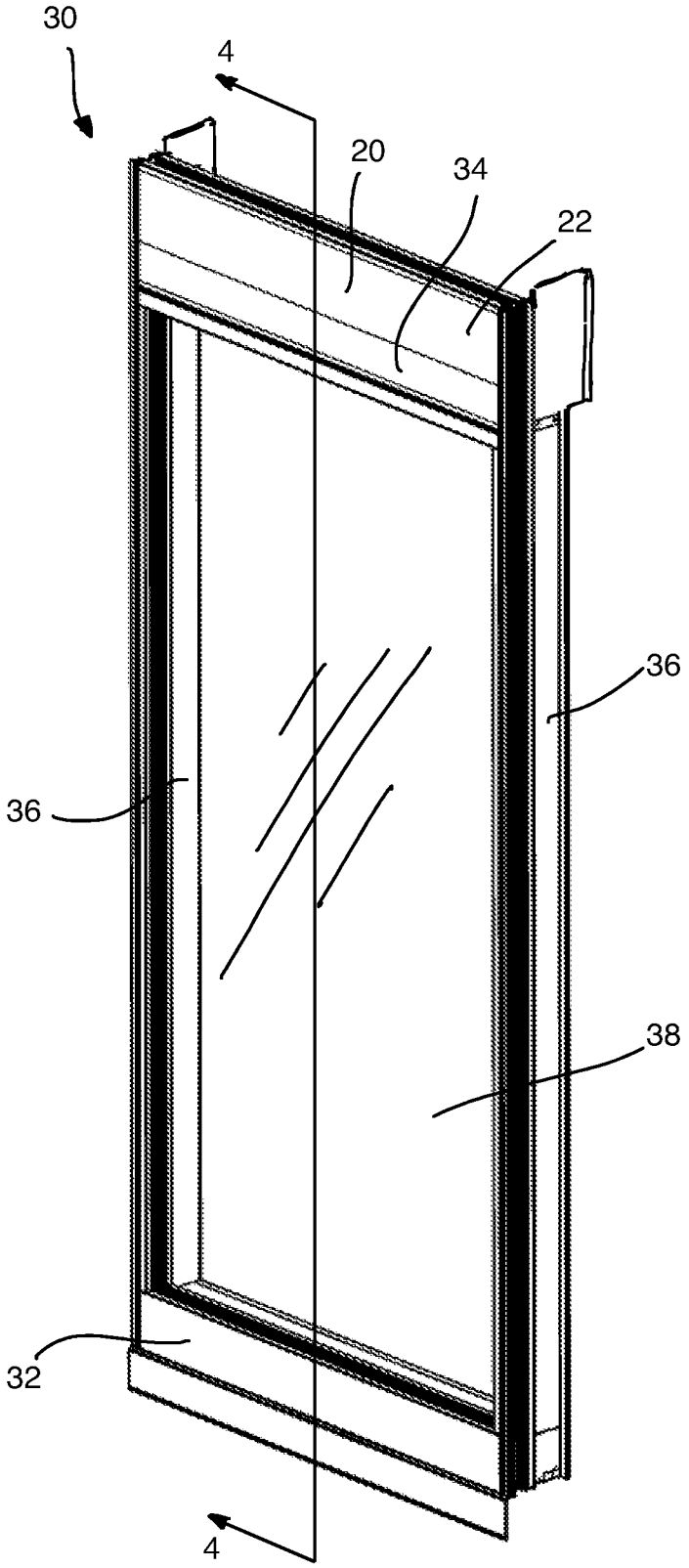
FIG. 3 is a perspective view of a window wall module of the window wall system of FIG. 1.
Figure 4:
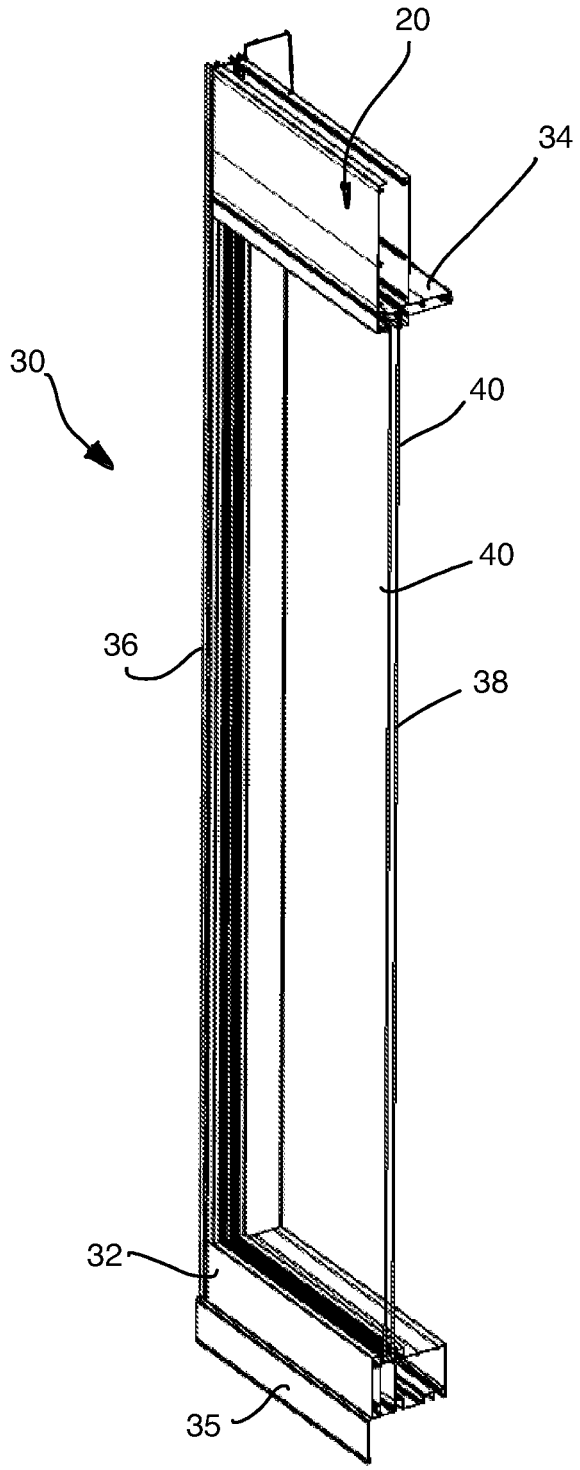
FIG. 4 is a perspective view of a cross-section of the window wall module of FIG. 3, taken along line 4-4 in FIG. 3.

With reference to FIG. 3, each window wall module 30 is generally rectangular and includes a bottom rail 32, a top rail 34 extending generally parallel to the bottom rail 32, and two vertical mullions 36 connected between the bottom and top rails 32, 34. A window panel 38 is retained between the bottom rail 32, the top rail 34 and the vertical mullions 36. In this embodiment, the window wall module 30 is double glazed such that the window panel 38 includes two glass panes 40 spaced apart from one another by top and bottom spacers 41. It is to be understood that FIG. 3 illustrates a particular type of window wall module 30 and not all window wall modules 30 of the window wall system 50 may actually be alike. In fact, as will be seen further below, the window wall system 50 includes window wall modules 30 of different types in accordance with their intended position in the building 10.

Figure 6A:
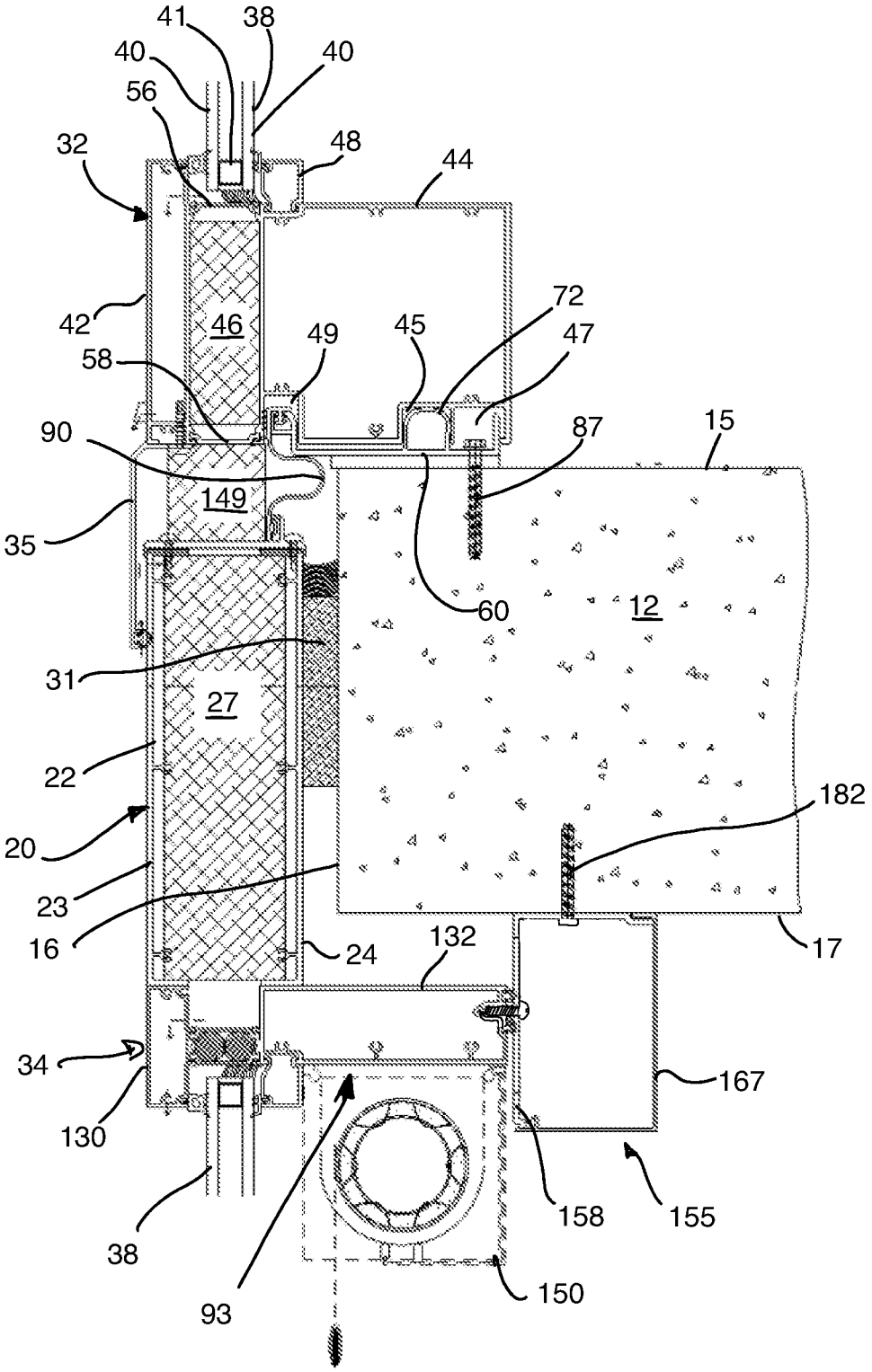
FIG. 6A is a detailed view of part of the cross-sectional view of FIG. 5, including an example of a bypass module of the window wall system.
Figure 6B:
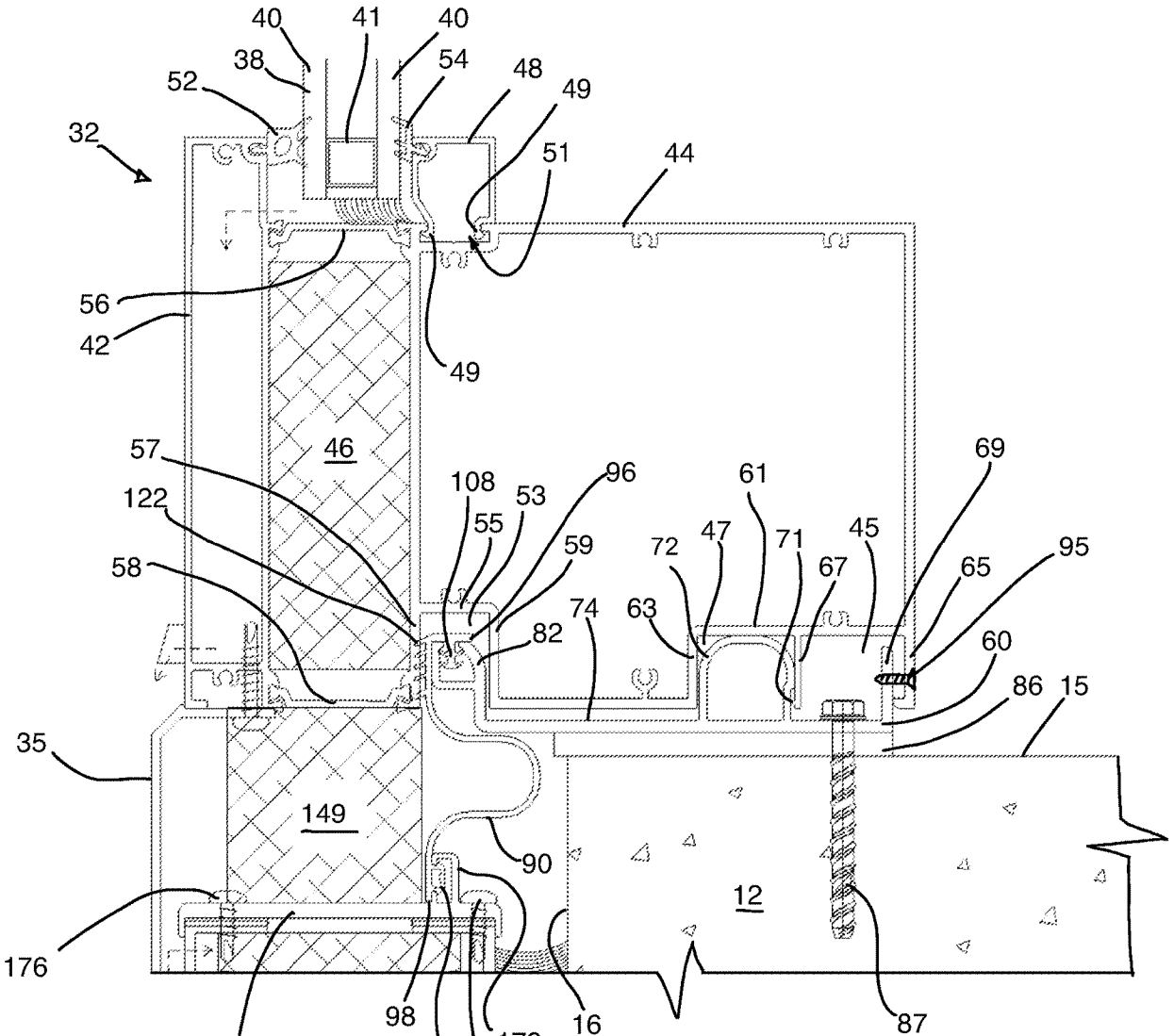
FIG. 6B is a detailed view of part of FIG. 6A.

As shown in FIG. 6B, the bottom rail 32 of the window wall module 30 has an outer member 42, an inner member 44, and a fire-resistant insulator 46 disposed between the outer and inner members 42, 44. The insulator 46 is made of an insulating material, namely polyethylene foam in this embodiment (e.g., Ethafoam®). It is contemplated that the insulator 46 may be made of any other suitable material in other embodiments. As can be seen, the outer member 42 and the inner member 44 are hollow members. Upper and lower members 56, 58 interconnect the outer and inner members 42, 44 to one another. In particular, each member 56, 58 is interlocked between the outer member 42 and the inner member 44. The insulator 46 is disposed between the upper and lower members 56, 58. A sealant is disposed between the lower end of the window panel 38 and the upper member 56 (and all around a periphery of the window panel 38).

Figure 5:
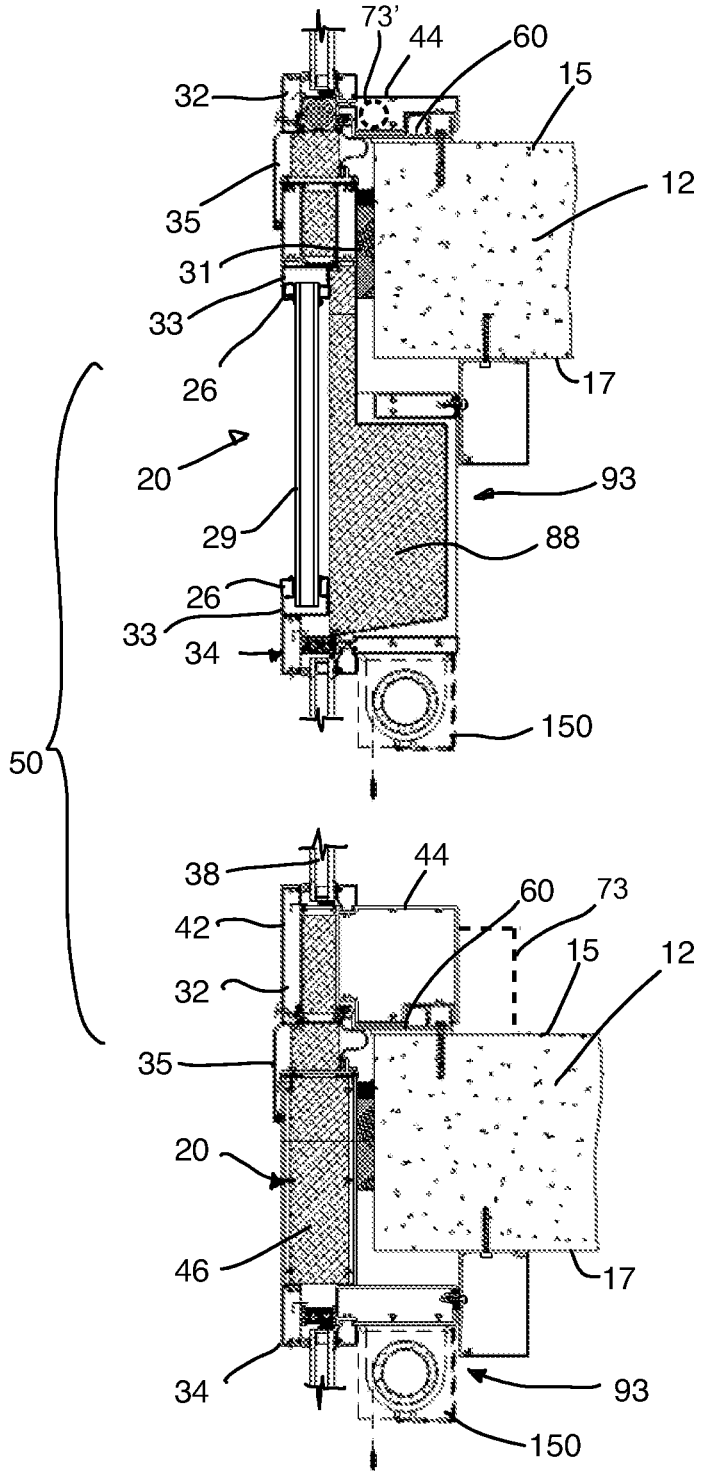
FIG. 5 is a cross-sectional view of top and bottom parts of the window wall module of FIG. 3 installed between two consecutive concrete slabs of the building.

It is noted that the outer member 42 and the inner member 44 could have different dimensions in accordance with the desired design. For example, as shown in FIG. 5, the topmost one of the bottom rails 32 illustrated therein has substantially smaller outer and inner members 42, 44. Furthermore, in some embodiments, as shown in dashed lines in FIG. 5, a radiator 73 may be secured to the outer surface of the inner member 44 of the bottom rail. In such embodiments, the inner member 44 may be taller to accommodate the dimensions of the radiator 73. Alternatively, in some embodiments, a radiator 73', also shown in dashed lines in FIG. 5, may be integrated with the inner member 44 so as to be at least partly enclosed by the inner member 44—for example when the inner member 44 has a smaller height.

The inner member 44 of the bottom rail 32 is configured to be connected to a corresponding anchoring bracket 60 as will be discussed in more detail below. To that end, in this embodiment, the inner member 44 defines a lower recess 45 extending longitudinally and which receives part of an anchoring bracket 60 therein. The recess 45 is defined by a lower horizontal wall 61 and two vertical opposed walls 63, 65 extending downward from the horizontal wall 61. A limiting deformable wall 67 extends downward from the horizontal wall 61, between the vertical opposed walls 63, 65 and generally parallel thereto. Notably, the limiting deformable wall 67 defines in part a sub-compartment 47 of the recess 45. In particular, the sub-compartment 47 of the recess 45 is defined between the lower horizontal wall 61, the vertical wall 63 and the limiting deformable wall 67. The inner member 44 also defines another lower recess 53 closer to an outer end of the inner member 44. The recess 53 is defined between a lower horizontal wall 55, an outer vertical wall 57 and an opposite vertical wall 59.

While the inner member 44 illustrated in FIGS. 6A and 6B has a significant height, the inner member 44 may be smaller for other window wall modules 30. For example, as can be seen in the top section of FIG. 5, the inner member 44 may have a smaller profile for other window wall modules 30.

Figure 19:
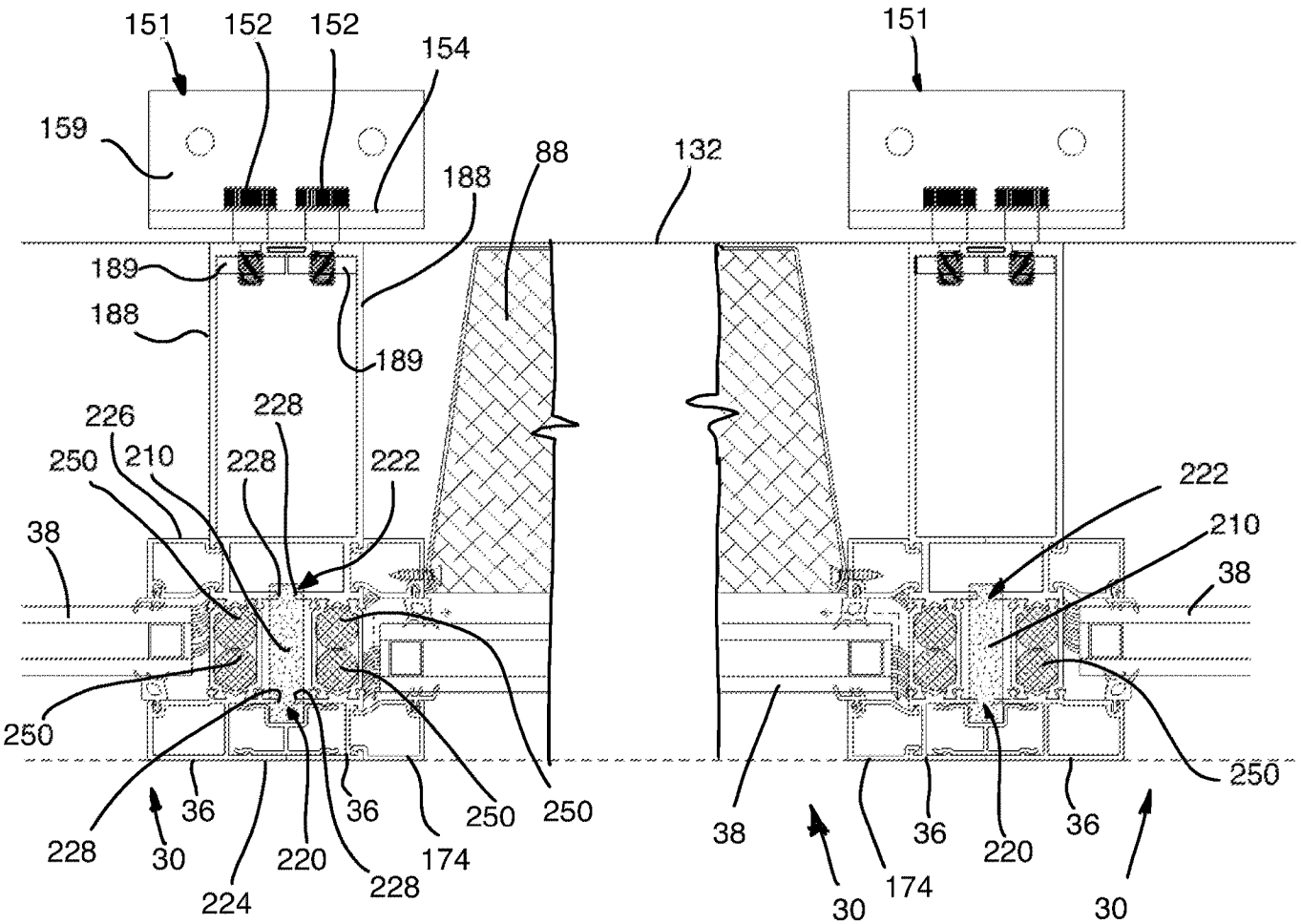
FIG. 19 is a cross-sectional view of part of three side-by-side window wall modules of the window wall system of FIG. 1 taken along a horizontal plane.
Figure 20A:
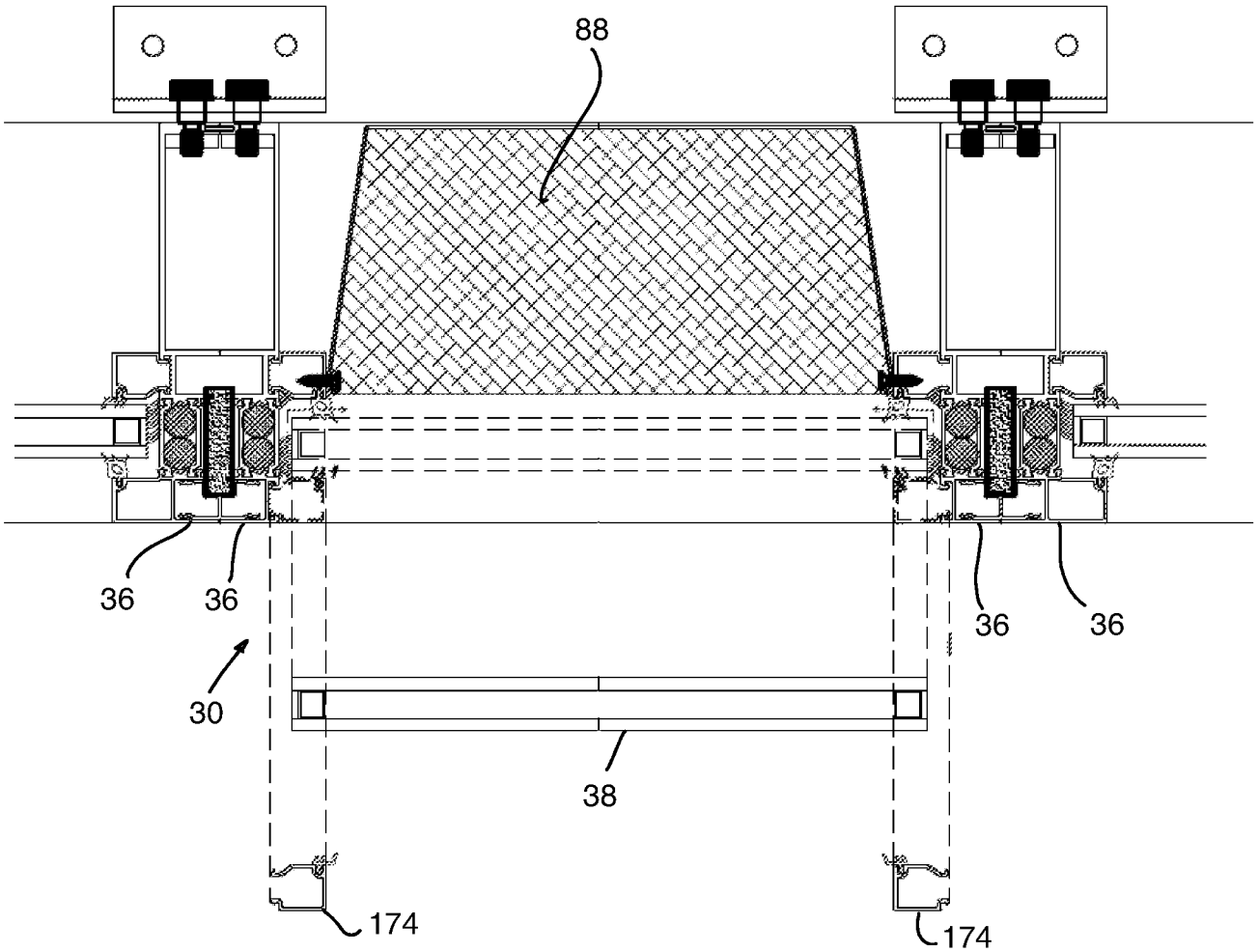
FIG. 20A is the cross-sectional view of FIG. 19 showing removable glazing beads of one of the window wall modules and a window panel thereof being removed.
Figure 20B:
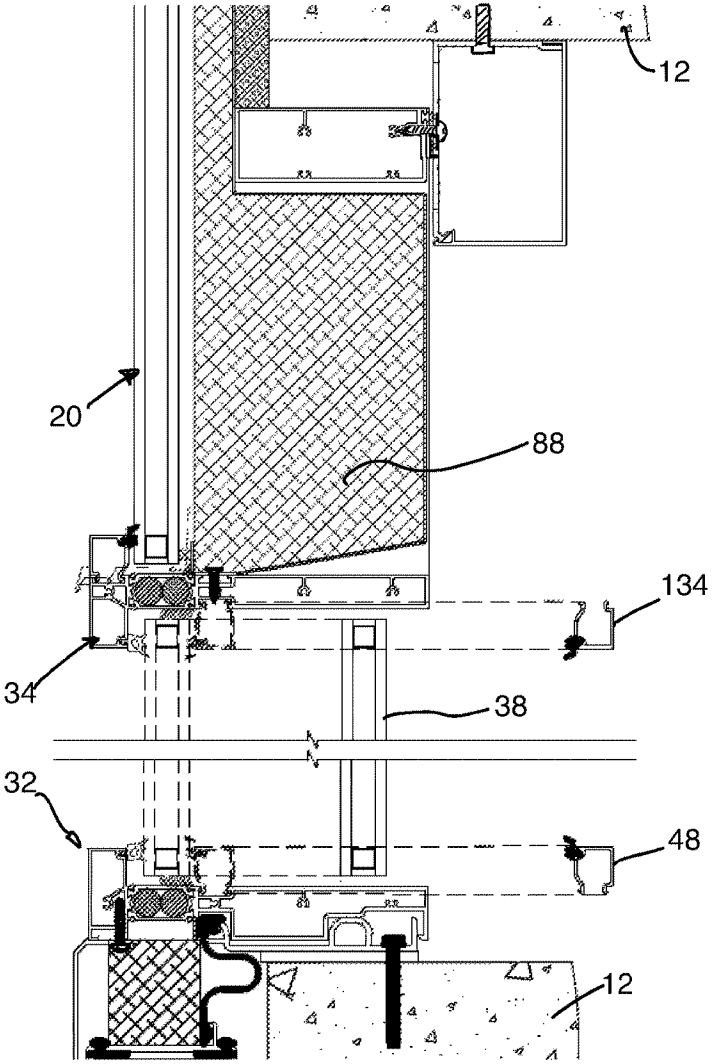
FIG. 20B is a cross-sectional view of one of the window wall modules, taken along a vertical plane, showing removable glazing beads of the bottom rail and the top rail of the window wall module and the window panel thereof being removed.

The window wall module 30 is configured so that the window panel 38 can be removed. To that end, a removable glazing bead 48 is affixed to an upper end of the inner member 44 near a perimeter of the window panel 38 to secure the window panel 38 in place. The removable glazing bead 48 has a generally U-shaped cross-sectional profile with square corners and has lower hooks 49 which hook onto a slot 51 defined in the upper end of the inner member 44. The removable glazing bead 48 and the outer member 42 sandwich a lower end of the window panel 38 therebetween. In this example, the removable glazing bead 48 is removable from the inside of the building 10 (i.e., without having to gain access to the window wall module 30 via the exterior). However, in some cases, where access to the window panel 38 may be restricted from the inside, as shown in FIG. 19, exterior removable glazing beads 174 may be disposed on the outer side of the window wall module 30. The removable glazing beads 174 for example extend vertically and are connected to the vertical mullions 36 of the window wall module 30. As an example, FIGS. 20A and 20B show the removable glazing beads 48, 174 being removed to remove the window panel 38.

In order to substantively prevent water from infiltrating into the bottom rail 32, a gasket 52 is disposed between the outer one of the glass panes 40 of the window panel 38 and the upper end of the outer member 42, while a gasket 54 is disposed between the inner one of the glass panes 40 of the window panel 38 and the upper end of the removable glazing bead 48. In this embodiment, the gaskets 52, 54 are made of vinyl, however it is contemplated that the gaskets 52, 54 could be made of any other suitable material in other embodiments.

A skirt member 35 is fastened to the lower end of the outer member 42 of the bottom rail 32 and extends downwardly therefrom. Notably, when the window wall module 30 is installed, the skirt member 35 covers in part a peripheral surface 16 of the concrete slab 12 to which the window wall module 30 is to be connected. In other words, the skirt member 35 is vertically aligned with at least part of the peripheral surface 16 of the concrete slab 16. In this embodiment, as shown in FIG. 6A, the skirt member 35 extends partly over the bypass module 20 disposed beneath the window wall module 30 of that skirt member 35 (i.e., is vertically aligned therewith and disposed outwardly therefrom). As such, the skirt member 35 conceals part of the bypass module 20 while also leaving uncovered part of the bypass module 20.

The outer and inner members 42, 44, the removable glazing bead 48 and the skirt member 35 are made of aluminum to keep the window wall module 30 relatively light.

Figure 6C:
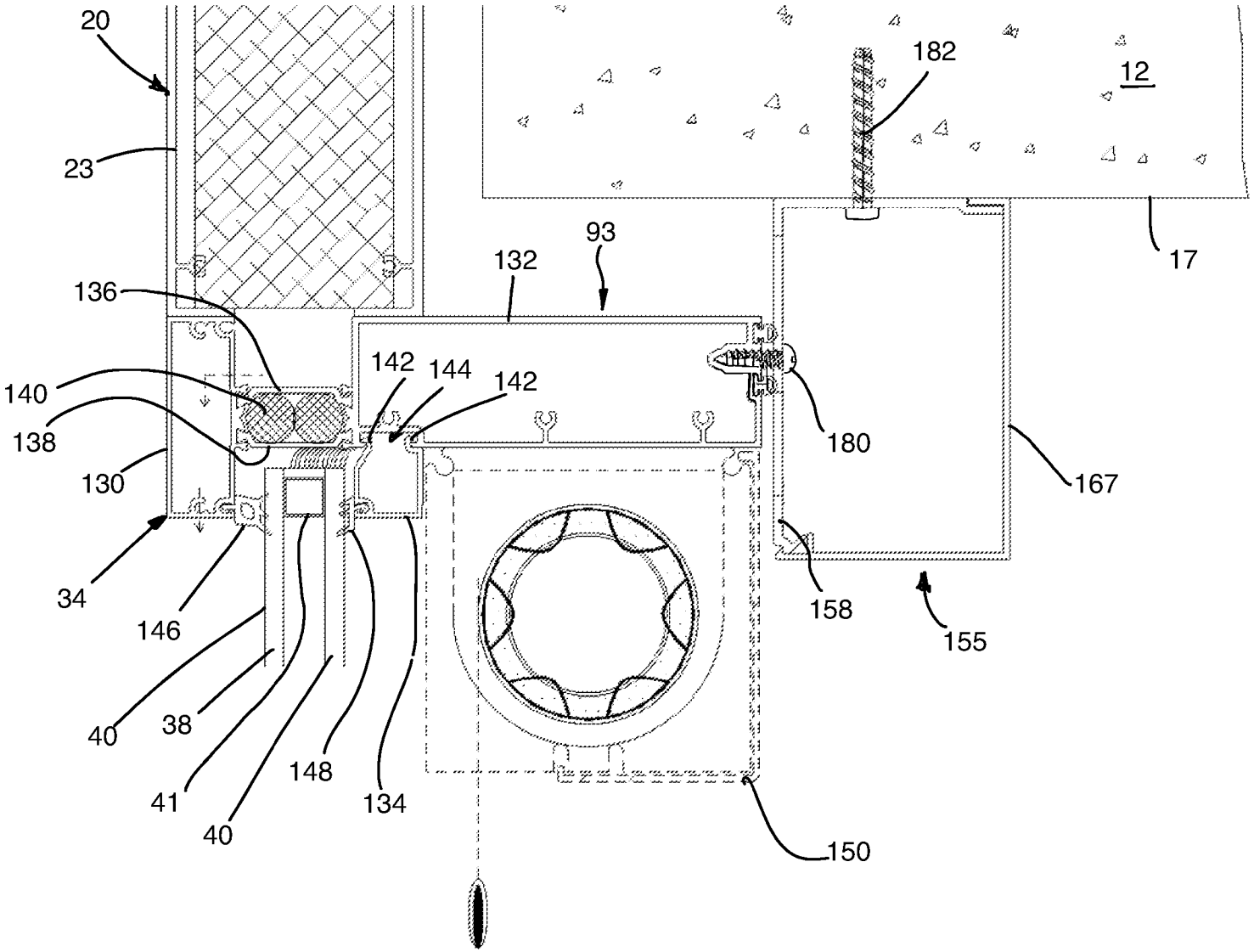
FIG. 6C is a detailed view of another part of FIG. 6A.

With reference now to FIG. 6C, the top rail 34 has an outer member 130, an inner member 132, and a removable glazing bead 134. As can be seen, the outer member 130 and the inner member 132 are hollow members. Upper and lower members 136, 138 interconnect the outer and inner members 130, 132 to one another. In particular, each member 136, 138 is interlocked between the outer member 130 and the inner member 132. An insulator 140 is disposed between the upper and lower members 136, 138. In this embodiment, the insulator 140 is made of the same material as the insulator 46. The removable glazing bead 134 is affixed to a lower end of the inner member 134 to secure the window panel 38 in place. The removable glazing bead 134 has a generally U-shaped cross-sectional profile with square corners and has upper hooks 142 which hook onto a slot 144 defined in the lower end of the inner member 132. The removable glazing bead 134 and the outer member 130 sandwich an upper end of the window panel 38 therebetween. In order to substantively prevent water from infiltrating into the top rail 34, a gasket 146 is disposed between the outer one of the glass panes 40 of the window panel 38 and the lower end of the outer member 130, while a gasket 148 is disposed between the inner one of the glass panes 40 of the window panel 38 and the lower end of the removable glazing bead 134. In this embodiment, the gaskets 146, 148 are made of vinyl, however it is contemplated that the gaskets 146, 148 could be made of any other suitable material in other embodiments.

The outer and inner members 130, 132 and the removable glazing bead 134 are made of aluminum to keep the window wall module 30 relatively light.

As can be seen, a blind 150 can optionally be attached to the inner member 132 of the top rail 34, notably since the various sealed points of the window wall module 30 are all aligned exteriorly of the inner member 132. As such, drilling into the inner member 132 to install the blind 150 does not affect the seal of the window wall module 30.

The manner in which a top portion of the window wall module 30 is connected to the corresponding top concrete slab 12 will be described in greater detail below.

As shown in FIG. 6A, each bypass module 20 extends between the top rail 34 of a lower window wall module 30 and the bottom rail 32 of an upper window wall module 30 disposed above the lower window wall module 30 to cover at least in part a peripheral surface 16 of the concrete slab 12 disposed therebetween. The bypass modules 20 can have different configurations. For instance, in a first example configuration shown in FIG. 6A, a bypass module 20 has an elongate and hollow aluminum body 22 including an outer wall 23 and an inner wall 24. An insulator 27 is disposed within the body 22, between the outer and inner walls 23, 24. In this example, the insulator 27 is made of mineral wool (e.g., rock wool). Another fire-resistant insulator 31 is installed between the bypass module 20 and the peripheral surface 16 of the adjacent concrete slab 12 (e.g., rock wool).

It is contemplated that the fire-resistant insulator 31 could have different thicknesses in different embodiments. With reference to FIG. 6A, in embodiments in which the fire-resistant insulator 31 is thicker, the anchoring bracket 60 could be dimensioned so as to extend further from an edge of the concrete slab 12.

As mentioned above, in this embodiment, each bypass module 20 is partly covered by the skirt member 35 that extends downwardly from the window wall module 30 thereabove. Notably, as shown in FIG. 6A, the skirt member 35 extends outwardly from and is vertically aligned with the outer wall 23 of a bypass module 20 disposed beneath the window wall module 30 corresponding to that skirt member 35.

Returning now to FIG. 5, as can be seen in the top section thereof, in another example configuration of a bypass module 20, the bypass module 20 can include top and bottom retaining members 33 and a window panel 29 retained therebetween. The window panel 29 includes two glass panes and thus is similar in construction to the window panel 38. Removable glazing beads 26 are removably connected to the top and bottom retaining members 33 to allow removal of the window panel 29 from the exterior. Moreover, as can be seen, in this embodiment, the bypass module 20 also includes an insulator 88 disposed inwardly of the window panel 29. The insulator 88 is a fire-resistant insulator (e.g., rock wool).

Figure 25:
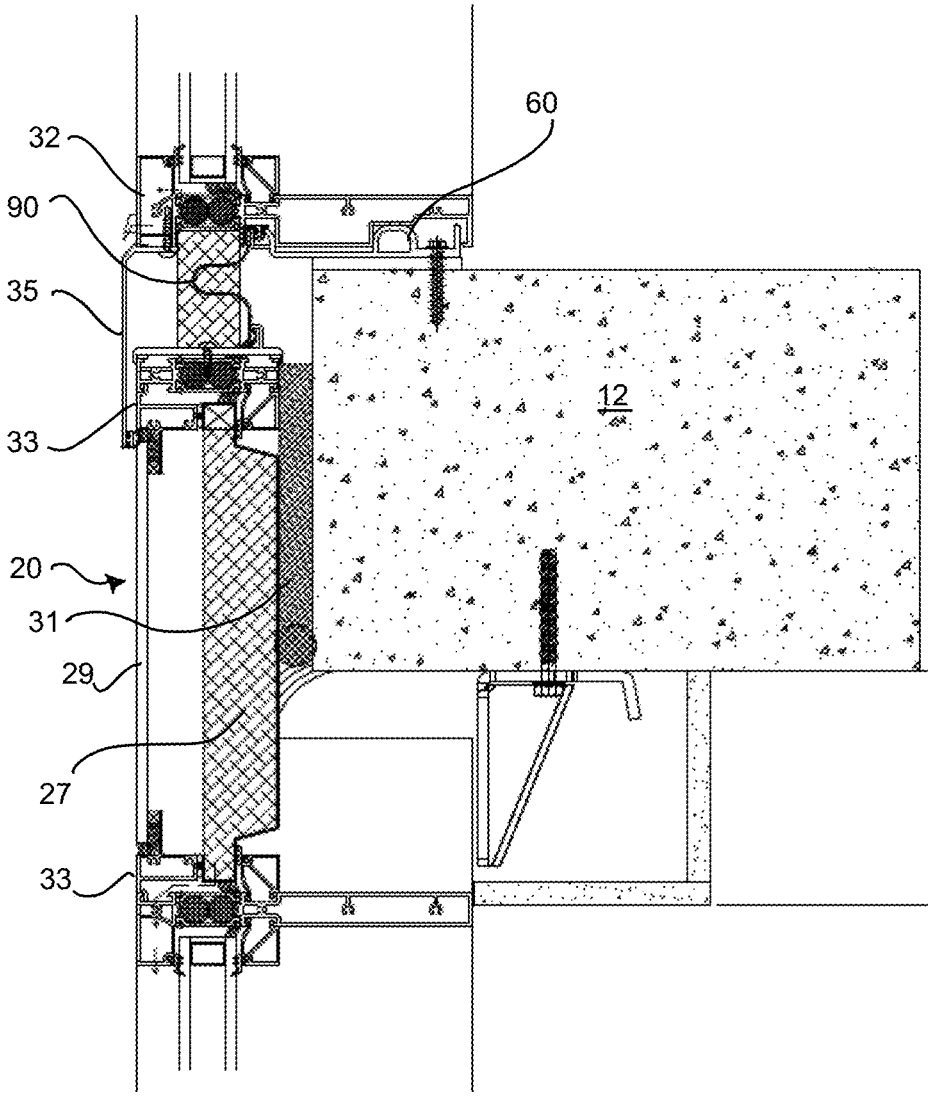
FIG. 25 is a cross-sectional view of a window wall module according to an alternative embodiment in which a skirt member of the window wall module conceals a retaining member of a bypass module disposed beneath the window wall module.

In some embodiments, as shown in FIG. 25, the skirt member 35 may entirely conceal the top retaining member 33 of a bypass module 20 (in embodiments in which the bypass module 20 has a window panel 29). For instance, as shown in FIG. 25, in some embodiments, a lower end of the skirt member 35 is vertically aligned with or disposed vertically lower than the lower end of the retaining member 33 that retains the top end of the window panel 29. In this embodiment of FIG. 25, the window panel 29 comprises a single glass pane of the bypass module 20 that is flush with the outer edges of the top and bottom retaining members 33.

Figure 8:
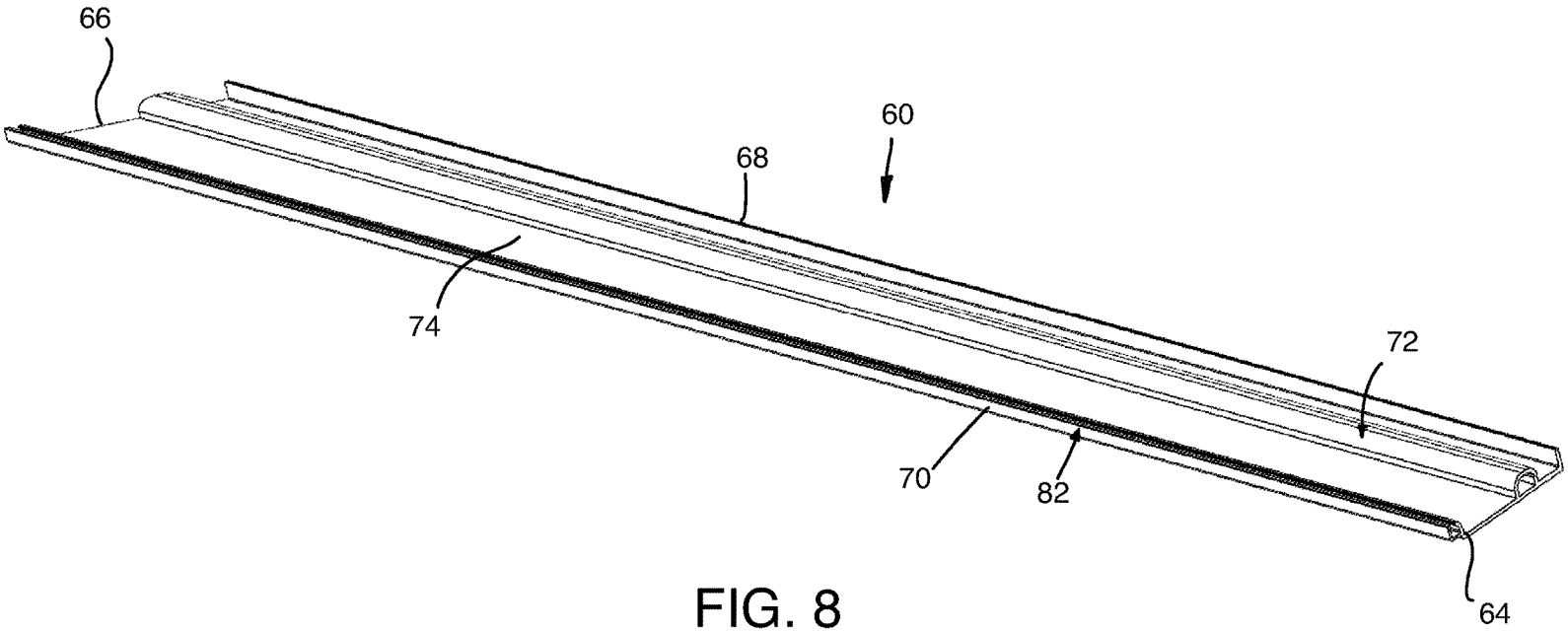
FIG. 8 is a perspective view of an exemplary one of the anchoring brackets of FIG. 7.

In order to install the window wall modules 30 in place, a plurality of anchoring brackets 60 are first installed on the concrete slabs 12 as shown in FIG. 8. As can be seen, the anchoring brackets 60 are affixed to the top surface 15 of a corresponding concrete slab 12. This is in contrast with curtain wall systems in which all anchoring of the curtain wall modules is typically done on the peripheral edge surface of the concrete slabs.

The anchoring brackets 60 will be described herein with particular reference to FIGS. 7 to 10. While the various anchoring brackets 60 may differ from one another in terms of length depending on their position in the building 10, in this embodiment, each anchoring bracket 60 has at least in part the same cross-sectional profile. As such, only one of the anchoring brackets 60 will be described in detail herein.

Figure 9:
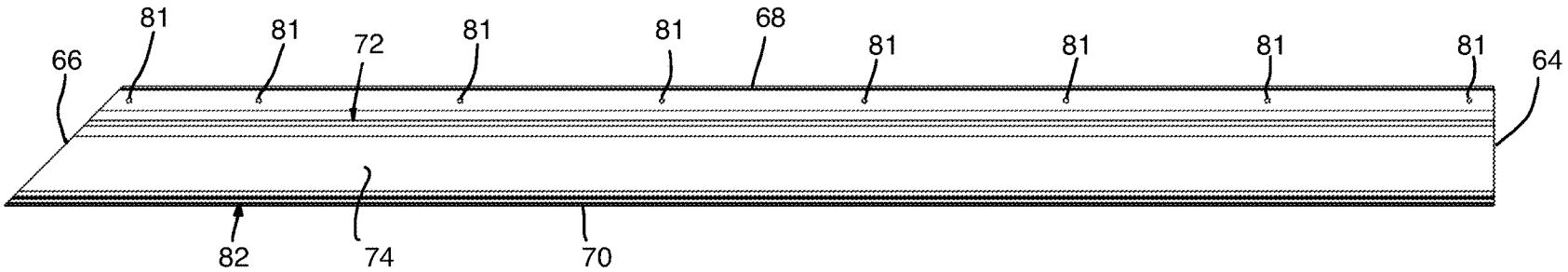
FIG. 9 is a top plan view of the anchoring bracket of FIG. 8.
Figure 10:
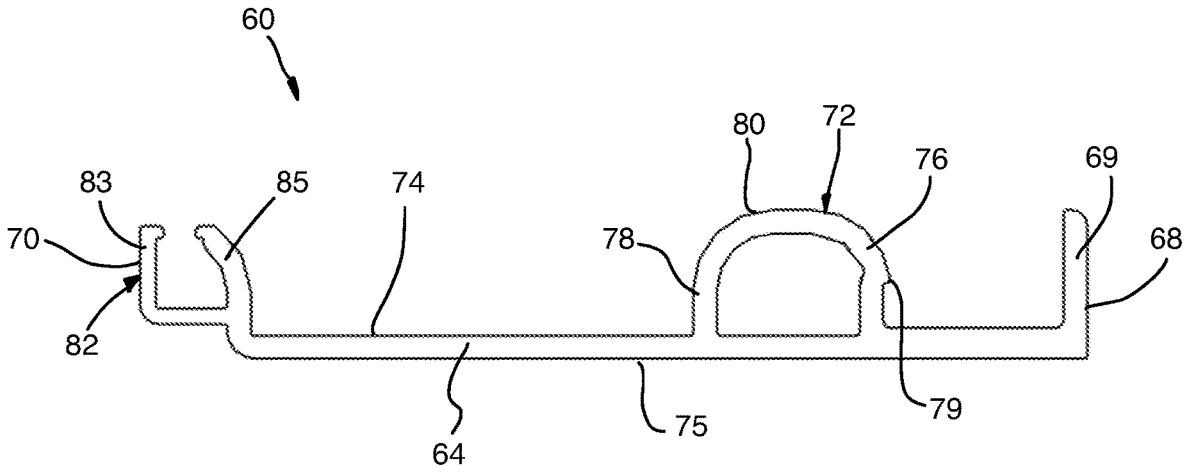
FIG. 10 is a side elevation view of the anchoring bracket of FIG. 8.

As shown in FIG. 8, the anchoring bracket 60 is an elongated member that extends between opposite longitudinal ends 64, 66 which define the length of the anchoring bracket 60 therebetween. The anchoring bracket 60 also has an inner end 68 and an outer end 70 which define a width of the anchoring bracket 60 therebetween. As shown in FIGS. 9 and 10, the anchoring bracket 60 has an upper surface 74 and a rail-engaging portion 72 that projects upwardly from the upper surface 74. A bottom surface 75 of the anchoring bracket 60 is flat and has no structures extending therefrom. The rail-engaging portion 72 extends along the length of the anchoring bracket 60. In this embodiment, the rail-engaging portion 72 has an inverted U-shape, including two upwardly-extending walls 76, 78 and a top wall 80 extending therebetween. The two upwardly-extending walls 76, 78 include an inner wall 76 and an outer wall 78, the inner wall 76 being closer to the inner end 68 than the outer wall 78 (i.e., a distance between the outer wall 78 and the inner end 68 being greater than a distance between the inner wall 76 and the inner end 68). The inner wall 76 of the rail-engaging portion 72 has a lip 79 (FIG. 10) extending towards the inner end 68 of the anchoring bracket 60 for retaining a window wall module 30 as will be described in greater detail below.

At its outer end 70, the anchoring bracket 60 has a membrane-receiving portion 82 that is configured to receive part of a sealing membrane as will be described in detail below. The membrane-receiving portion 82 is generally shaped like a horseshoe and includes two upwardly-extending walls 83, 85 defining an open upper end of the membrane-receiving portion 82. In particular, the distance between the walls 83, 85 is smallest at their upper ends.

At its inner end 68, the anchoring bracket 60 has a vertical wall 69 that extends perpendicular to the top surface 74.

In this embodiment, each anchoring bracket 60 is a single-piece component which is extruded into shape. Thus, to produce the anchoring brackets 60, a manufacturer can extrude a long piece of anchoring bracket stock and cut it into various lengths as needed to obtain the anchoring brackets 60. As can be understood, this simple method of manufacturing can result in cost savings for the implementation of the window wall system 50 since the anchoring brackets 60 are relatively inexpensive to produce.

Figure 7:
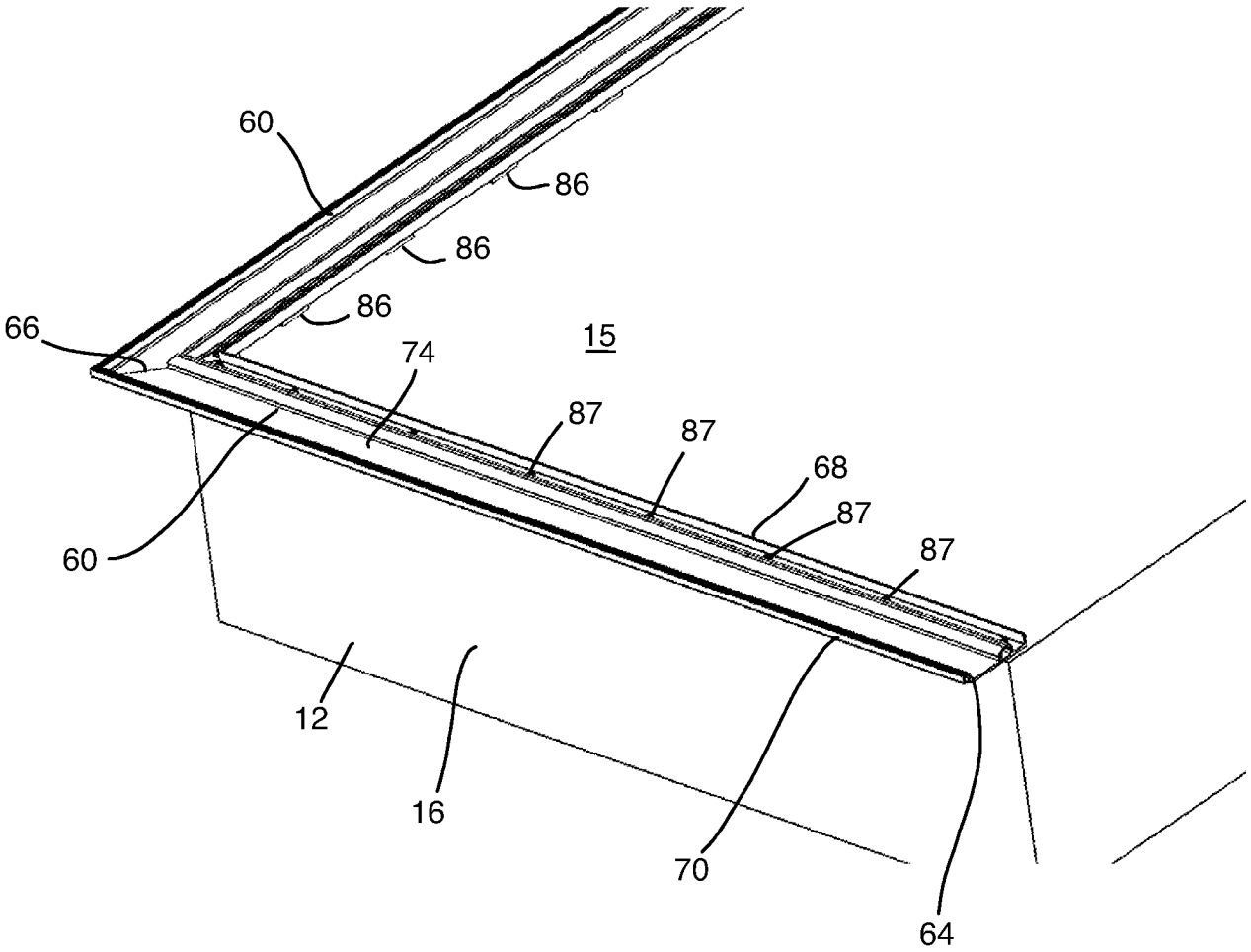
FIG. 7 is a perspective view of anchoring brackets of the window wall system of FIG. 1 affixed to a concrete slab of the building.

To affix the anchoring brackets 60 to a corresponding concrete slab 12, as shown in FIG. 7, fasteners 87 are aligned with corresponding openings 81 (FIG. 9) defined in the upper surface 74 of each anchoring bracket 60 and driven through the concrete slab 12 to securely engage the anchoring bracket 60 with the concrete slab 12. For instance, in this example, the fasteners 87 are wedge bolts. As shown in FIGS. 6B and 7, spacers 86 may be placed underneath the anchoring brackets 60, aligned with the openings 81, to position the anchoring brackets 60 at an adequate height to install the window wall modules 30.

Figure 15:
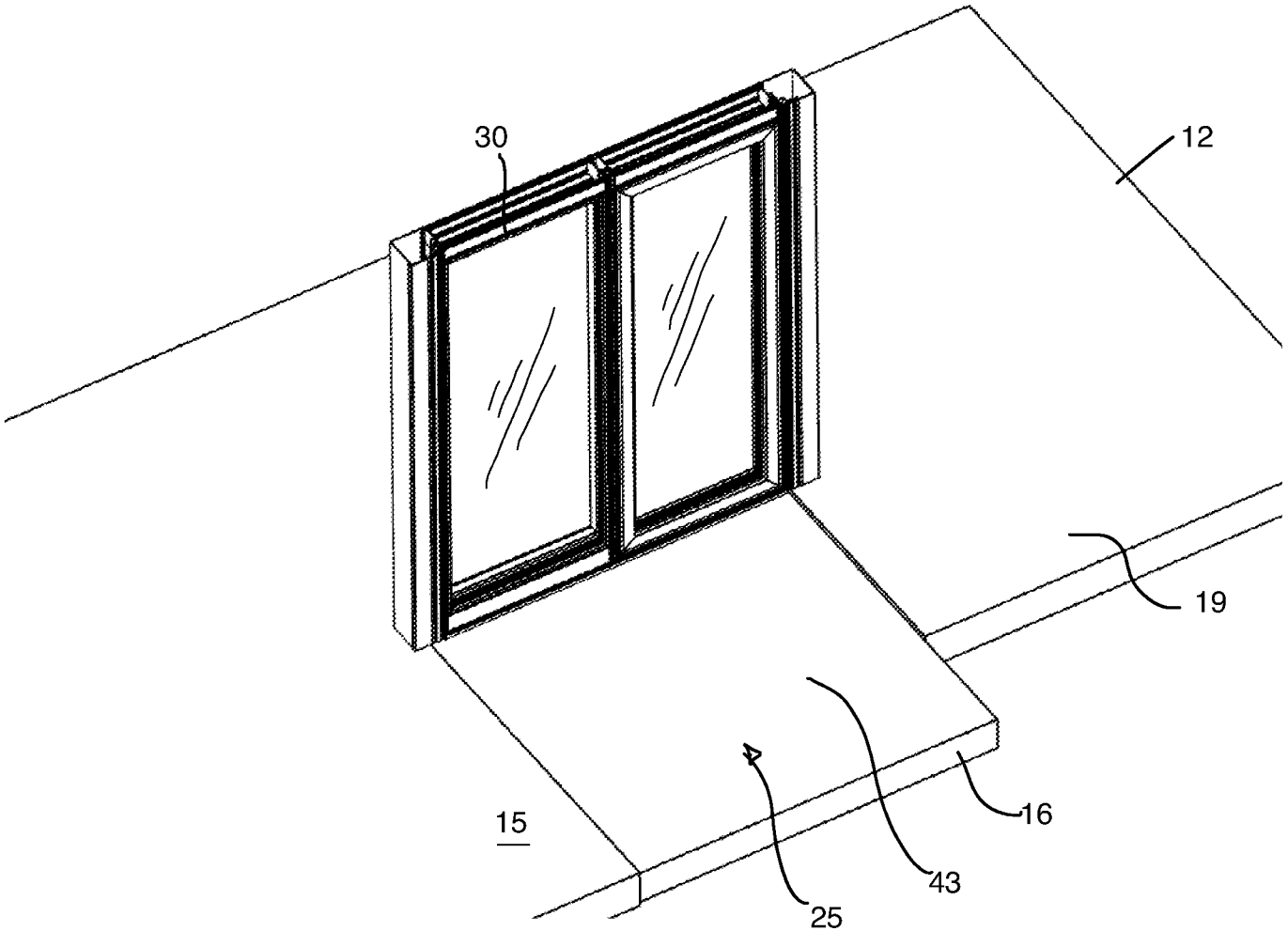
FIG. 15 is a perspective view of one of the window wall modules of the window wall system of FIG. 1 installed at a balcony area of the building.
Figure 16:
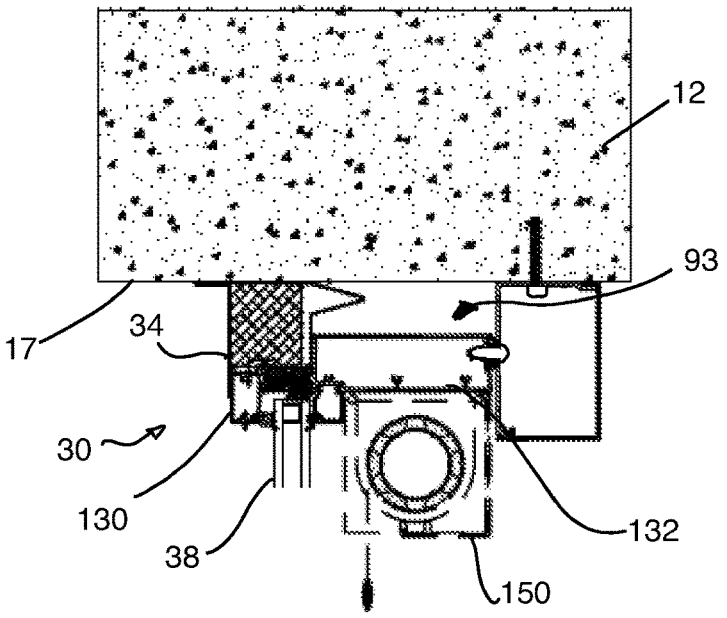
FIG. 16 is a cross-sectional view of the window wall module of FIG. 15 connected between two consecutive concrete slabs of the building.
Figure 16:
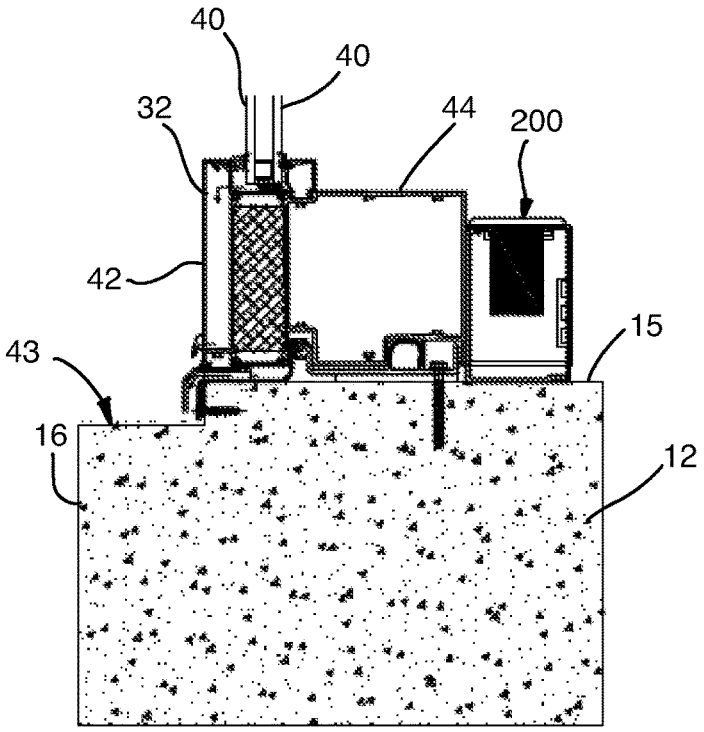

As can be seen in FIG. 7, when installed on the concrete slabs 12, the anchoring brackets 60 are positioned at least partly on the top surface 15 of a corresponding concrete slab 12 along the peripheral edge of the concrete slab 12 (i.e., near to the peripheral surface 16) if they are to be connected to a bypass module 20. For instance, as shown in FIG. 11, a portion of the anchoring brackets 60 may extend outward from the peripheral edge of the concrete slab 12. However, in some cases, as shown in FIGS. 15 and 16 for example, the anchoring brackets 60 are installed around a stepped portion 43 of the concrete slab 12 forming a balcony area 25 of the building 10 (see FIG. 15). The stepped portion 43 has an upper surface that is vertically lower than an upper surface of an upper portion 19 of the concrete slab 12 at least partly surrounding the stepped portion 43.

Figure 24:
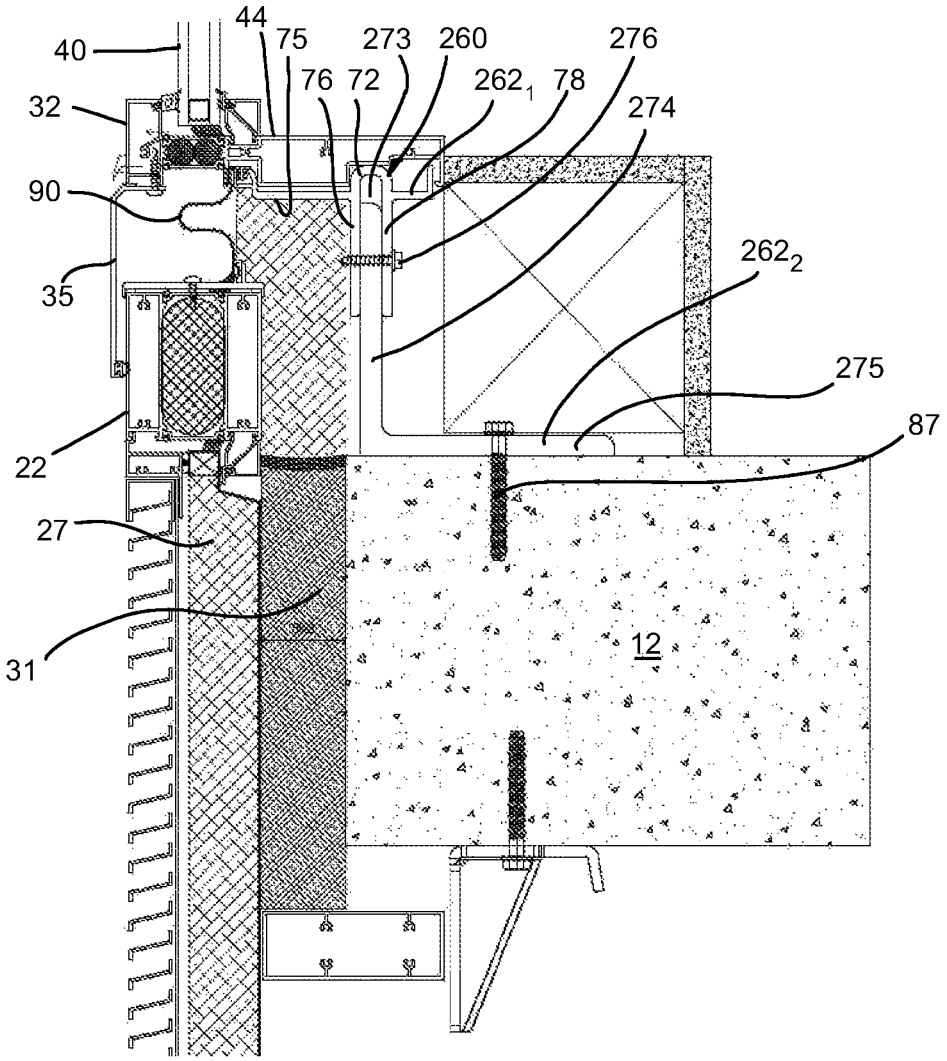
FIG. 24 is a cross-sectional view of a window wall module according to an alternative embodiment in which the anchoring bracket includes multiple components.

In the embodiment of FIG. 7, the anchoring bracket 60 is composed of a single component. However, in other embodiments, the anchoring bracket may comprise multiple components. For instance, as shown in FIG. 24, an anchoring bracket 260 could include at least two bracket members $\mathbf{262}_1$, $\mathbf{262}_2$ that are connected to one another to form the anchoring bracket 260. In this example of implementation, the bracket member $\mathbf{262}_2$ has an L-shaped cross-sectional profile while the bracket member $\mathbf{262}_1$ has generally the same shape as the anchoring bracket 60 described above (and therefore the same elements thereof have been identified with the same reference numerals) with the exception that the two upwardly-extending walls 76, 78 of the rail-engaging portion 72 also extend downwardly from the bottom surface 75 and define an open slot 273 to receive part of the bracket member $\mathbf{262}_2$ therein. Notably, the slot 273 receives a vertical portion 274 of the bracket member $\mathbf{262}_2$ therein which is perpendicular to a horizontal portion 275 of the bracket member $\mathbf{262}_2$. The vertical portion 274 is fastened to the upwardly-extending walls 76, 78 of the bracket member $\mathbf{262}_1$ by fasteners 276. The horizontal portion 275 of the bracket member $\mathbf{262}_2$ is fastened to the concrete slab 12 by the fasteners 87. As such, the bracket member $\mathbf{262}_1$ is elevated off the top surface of the concrete slab 12, and the sealing membrane 90, which is interlocked with the bracket member $\mathbf{262}_1$, is not vertically aligned with the top surface of the concrete slab 12 (as it is disposed vertically higher than the top surface of the concrete slab 12 to which the anchoring bracket 260 is connected to).

It is contemplated that, in some cases, the anchoring brackets 60 may be sold as a standalone product so that contractors can use them to install compatible window wall modules.

Figure 11A:
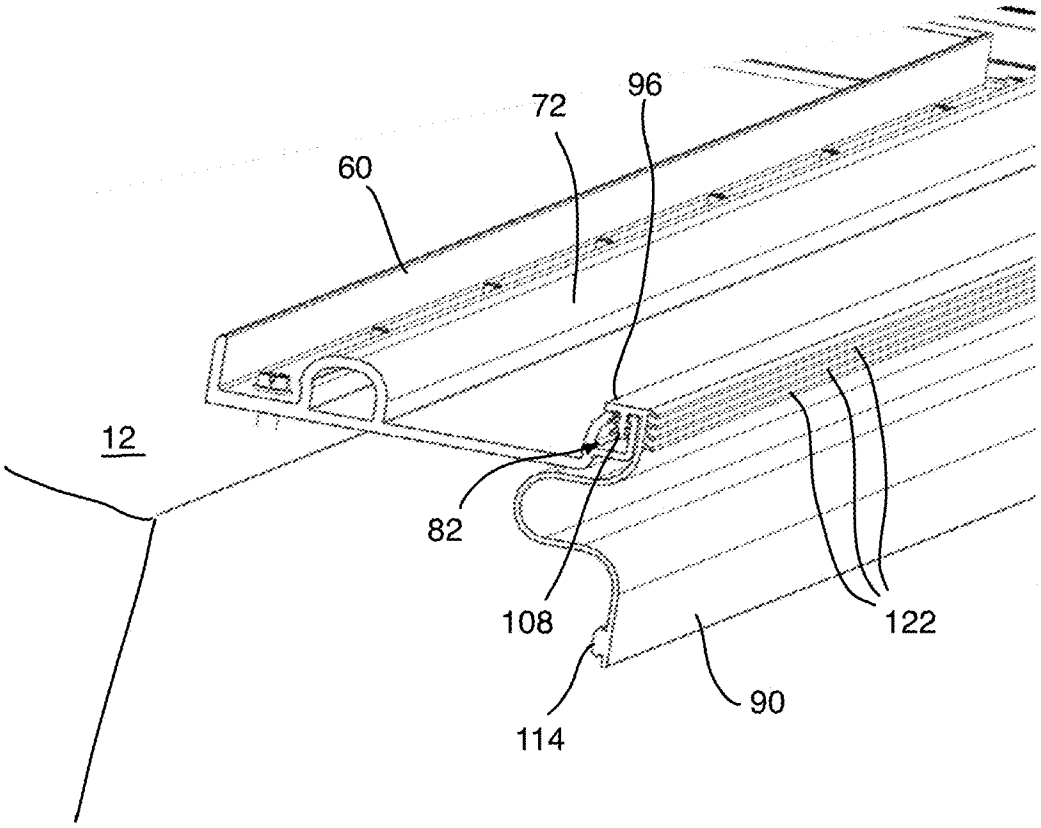
FIG. 11A is a perspective view of one of the anchoring brackets and a sealing membrane of the window wall system of FIG. 1 affixed thereto.
Figure 11B:
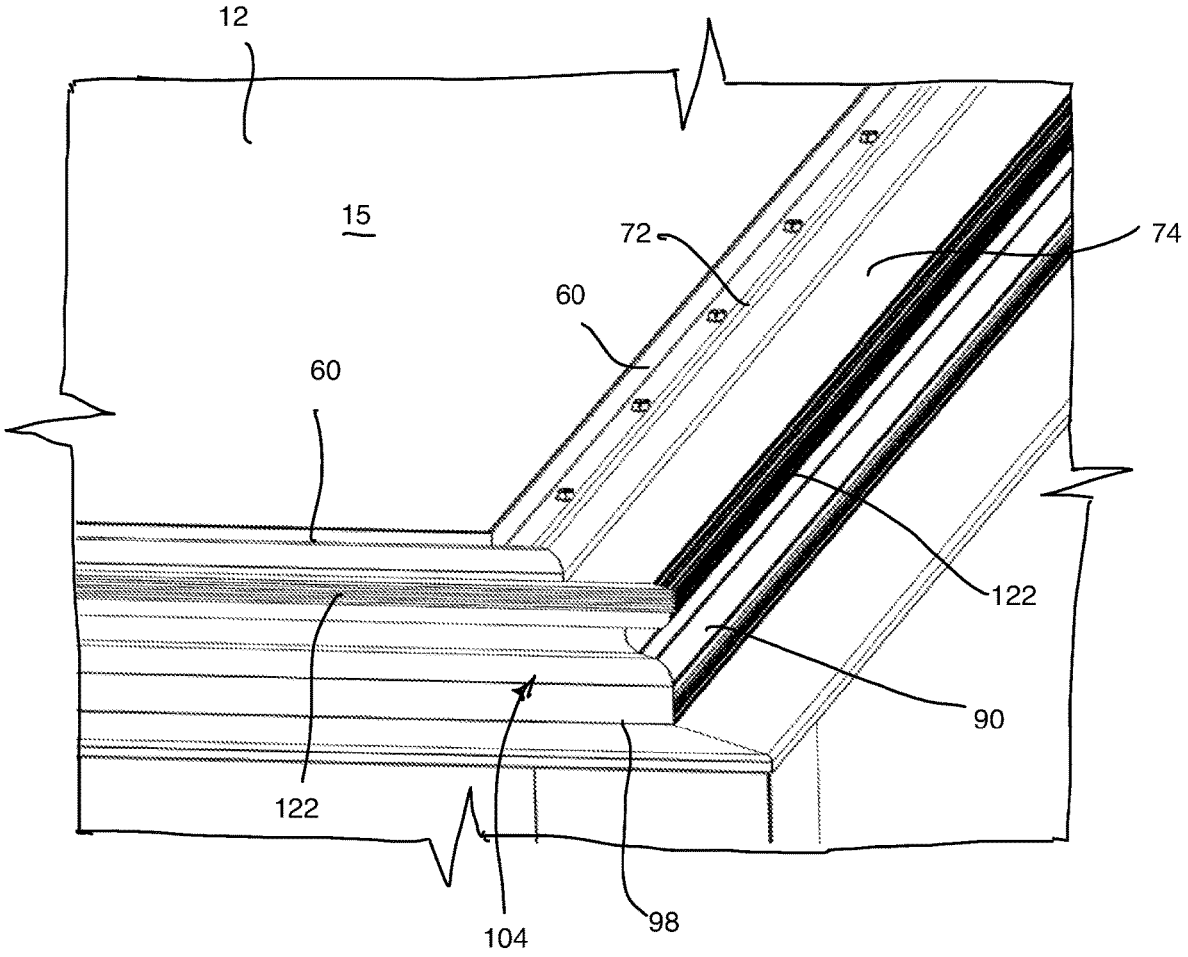
FIG. 11B is a perspective view of two anchoring brackets forming a corner and a sealing membrane affixed thereto.

Once the anchoring brackets 60 are fixed to the concrete slabs 12, as can be seen in FIG. 11A, a plurality of preformed sealing membranes 90 are affixed to the anchoring brackets 60 for forming a seal at the bottom ends of the window wall modules 30 and to prevent water from reaching the portion of the concrete slabs 12 forming the interior of the building 10. The sealing membranes 90 are said to be "preformed" in that their shape is formed prior to being affixed to the anchoring brackets 60. For instance, a cross-sectional profile of each sealing membrane 90 is formed prior to the sealing membrane 90 being affixed to the corresponding anchoring bracket 60. This is in contrast for example to caulking that is applied in many conventional window wall systems via a caulking dispenser and which has to cure for a given amount of time to form the desired seal. Furthermore, as will be seen below, the sealing membranes 90 are easier to install than the bitumen sheets used in conventional window wall systems to wrap around the periphery of the concrete slabs.

The sealing membranes 90 are made of elastomeric material and thus are substantially flexible. Moreover, the elastomeric material of the sealing membranes 90 is impermeable. For example, in this embodiment, the elastomeric material of the sealing membrane 90 is silicone. Nevertheless, it is contemplated that the sealing membranes 90 may be made of any other suitable elastomeric materials in other embodiments. For instance, the elastomeric material of the sealing membranes 90 may be any suitable silicone-based material in other embodiments.

The sealing membranes 90 will be described herein with particular reference to FIGS. 12 and 13. While the various sealing membranes 90 may differ from one another in terms of length depending on their position in the building 10, in this embodiment, each sealing membrane 90 has the same cross-sectional profile. As such, only one of the sealing membranes 90 will be described in detail herein.

Figure 12:
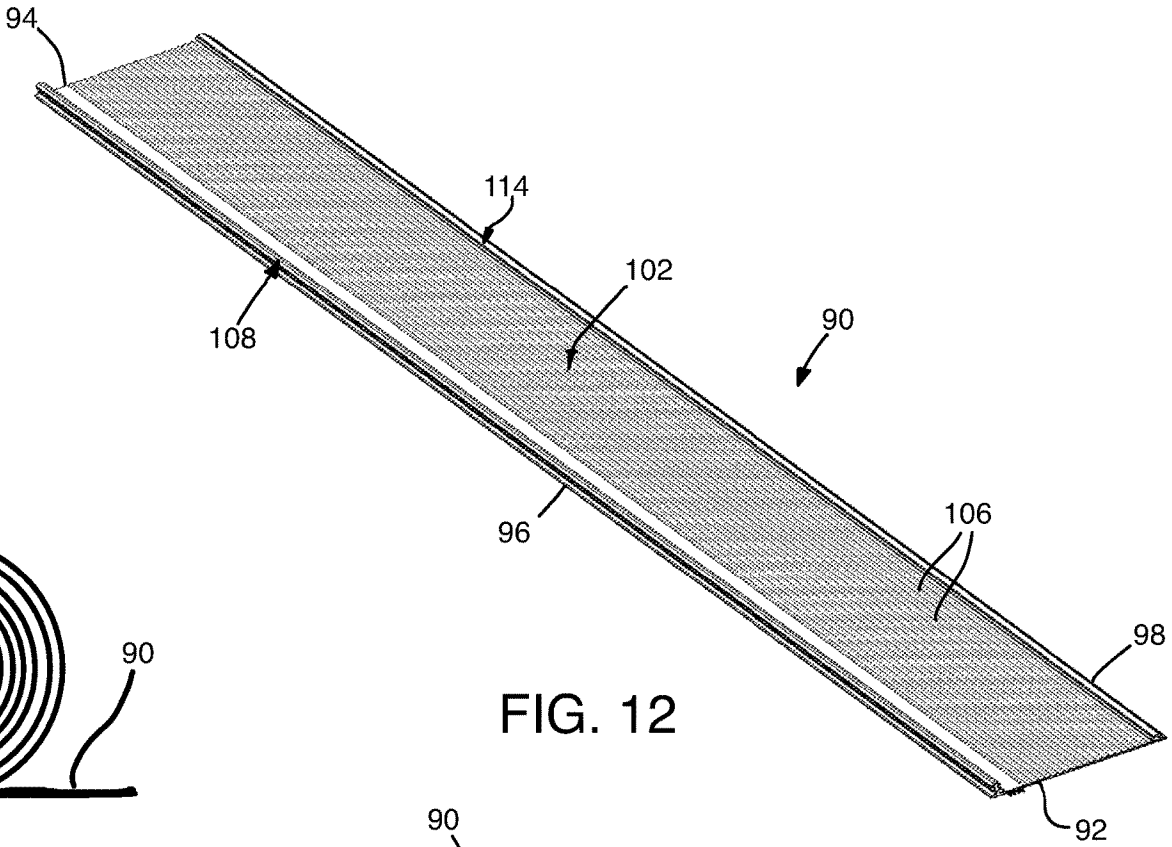
FIG. 12 is a perspective view of an exemplary one of the sealing membranes of the window wall system of FIG. 1, in a flattened configuration.

As shown in FIG. 12, the sealing membrane 90 extends between opposite longitudinal ends 92, 94 which define the length of the sealing membrane 90 therebetween. The sealing membrane 90 also has a lateral end 96 and an opposite lateral end 98 which define a width of the sealing membrane 90 therebetween. The sealing membrane 90 has a first side 102 defining a surface 103, and a second side 104 (opposite the first side 102) defining a surface 105. The first side 102 of the sealing membrane 90 has a plurality of ridges 106 protruding from the surface 103 and extending parallel to one another along the length of the membrane 90. In this embodiment, the ridges 106 have a semi-circular cross-sectional profile. The ridges 106 may be shaped differently in other embodiments.

The sealing membrane 90 also has an interlocking portion 108 on the first side 102, near the lateral end 96. As can be seen, the interlocking portion 108 has a main body 110 protruding from the surface 103 and a plurality of legs 112 extending generally laterally from the main protrusion 110. In particular, two legs 112 extend from the main body 110 toward the lateral end 96 of the membrane 90, while two other legs 112 extend form the main body 110 toward the opposite lateral end 98. The sealing membrane 90 may have additional or fewer legs 112 in other embodiments. The main body 110 extends generally perpendicular from the surface 103. As will be explained in greater detail below, the interlocking portion 108 of the sealing membrane 90 is used to affix the sealing membrane 90 to the corresponding anchoring brackets 60.

Near the opposite lateral end 98, the sealing membrane 90 has another interlocking portion 114 on the first side 102. The interlocking portion 114 protrudes from the surface 103 and has a generally rectangular cross-sectional profile, albeit having two laterally-extending lips 116, 118 forming a head of the interlocking portion 114. The lips 116, 118 extend from opposite lateral sides of the interlocking portion 114. The interlocking portion 114 also defines a central channel 120 between its lateral walls and top wall. As can be seen, a height of the interlocking portion 108 is greater than the height of the interlocking portion 114.

The sealing membrane 90 also has a plurality of legs 122 extending from the surface 105 on the second side 104. The legs 122 are angled toward the lateral end 98 of the sealing membrane. As will be described in greater detail below, in use, the legs 122 are configured to engage a surface of the bottom rail 32 of a corresponding window wall module 30, namely to provide a seal by engaging the outer vertical wall 57 of the inner member 44.

Figure 13:
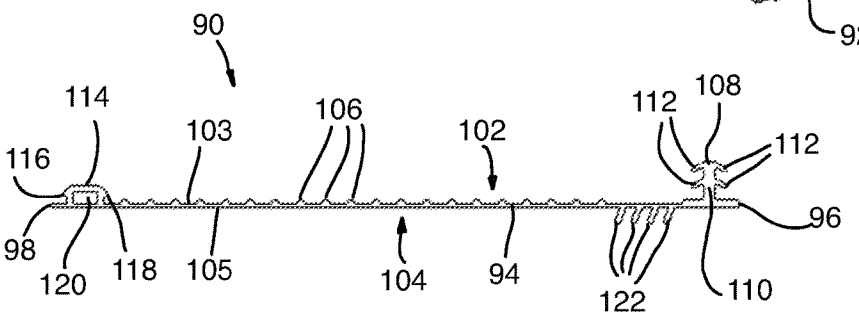
FIG. 13 is a side elevation of the sealing membrane of FIG. 12.

As will be understood, FIGS. 12 and 13 show the sealing membrane 90 in a flattened configuration for ease of reference. However, the shape of the flexible sealing membrane 90 is different when installed to provide a seal of the window wall system 50.

Figure 14:
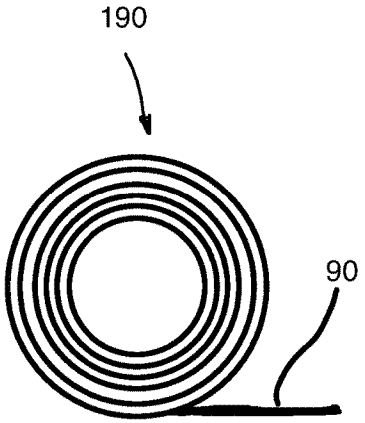
FIG. 14 shows a roll of sealing membrane stock from which the sealing membranes are cut.

With reference to FIG. 14, in this embodiment, sealing membrane stock is produced and formed into rolls 190 from which the sealing membranes 90 are rolled out and placed onto the anchoring brackets 90 for affixing thereto. In particular, in order to affix a sealing membrane 90 to one or more anchoring brackets 60, as shown in FIG. 11A, the interlocking portion 108 of the sealing membrane 90 is inserted into the membrane-receiving portion 82 of the anchoring brackets 60. The legs 112 extending from the main body 110 of the interlocking portion 108 collaborate with the restrictive shape of the membrane-receiving portion 82 of the anchoring brackets 60 to prevent the sealing membrane 90 from disengaging the membrane-receiving portion 82. Moreover, a single length of sealing membrane 90 can be interlocked with various anchoring brackets 60, even where two anchoring brackets 60 form a corner as shown for example in FIG. 11B. Notably, the sealing membrane 90 can traverse such corners without bunching up the sealing membrane 90 because the lateral ends 96, 98 of the sealing membrane 90 are substantially vertically aligned with one another such that the lateral end 96 is generally vertically above the lateral end 98 as shown in FIG. 6B for example. For instance, in some cases, the lateral ends 96, 98 of the sealing membrane 90 may be within 5 cm of being vertically aligned. In some cases, the lateral ends 96, 98 of the sealing membrane 90 may be within 3 cm of being vertically aligned.

As can be seen, in the configuration of FIG. 6B (i.e., the "bypass configuration"), because the membrane-receiving portion 82 of the anchoring bracket 60 extends outward from the peripheral edge of the concrete slab 12, the sealing membrane 90 hangs off the anchoring bracket 60 and does not contact the concrete slab 12. However, for the sealing membranes 90 that surround respective balcony areas 25 of the building 10 (FIG. 17)—i.e., the "balcony configuration"—the sealing membrane 90 lays at least partially atop part of the concrete slab 12. Thus, in the balcony configuration, the lateral end 98 of the sealing membrane 90 is affixed to the concrete slab 12. To do this, an adhesive 113 (e.g., silicone) is applied between the membrane 90 and the part of the concrete slab 12 that it contacts. Then, fasteners 115 are inserted through the interlocking portion 114 of the sealing membrane 90 and into a vertical edge surface 117 extending between the stepped portion 43 and the upper portion 19 of the concrete slab 12.

While the sealing membranes 90 are setup differently in the bypass and balcony configurations, the same sealing membrane stock is used for both instances. That is, the same sealing membranes 90 that are used to form the seal for the balcony configuration are used to form the seal for the bypass configuration (e.g., their cross-sectional profiles are the same). In that sense, the "balcony sealing membrane" 90 used for the balcony configuration is interchangeable with the "bypass sealing membrane" 90 used for the bypass configuration. This requires less expense as the same tooling is used to produce all the sealing membrane 90 and the producer does not need to carry two types of sealing membrane in stock.

Furthermore, the sealing membranes 90 in the bypass configuration are continuous in that each sealing membrane 90 can extend along various ones of the window wall modules 30, thus resulting in fewer "junctions" between separate sealing membranes which could potentially reduce the effectiveness of the seal provided by the sealing membranes 90.

Once the one or more sealing membranes 90 are in place on the anchoring brackets 60 affixed to any given one of the concrete slabs 12, a first one of the window wall modules 30 is installed on a given one of the anchoring brackets 60. The window wall modules 30 come pre-assembled and therefore the installation on-site is quick. As discussed above, and as best shown in FIG. 6B, the bottom rail 32 of that window wall module 30 is placed atop the anchoring bracket 60 such that the rail-engaging portion 72 of the anchoring bracket 60 is received in the sub-compartment 47 of the recess 45 and the membrane-receiving portion 82 is received in the recess 53. As the rail-engaging portion 72 enters the sub-compartment 47, the limiting deformable wall 67 is displaced slightly until the lip 79 of the rail-engaging portion 72 is past an enlarged portion 71 of the limiting deformable wall 67 located at the tip thereof (i.e., the rail-engaging portion 72 is snapped into the sub-compartment 47). At this point, the rail-engaging portion 72 is secured in the sub-compartment 47 of the recess 45. A plurality of screws 95 (one of which is shown in FIG. 6B) are then inserted through the vertical wall 65 of the inner member 44 and the vertical wall 69 of the anchoring bracket 60 to secure the bottom rail 32 to the anchoring bracket 60.

At the opposite end of the anchoring bracket 60, the membrane-receiving portion 82 of the anchoring bracket 60 and the interlocking portion 108 of the sealing membrane 90 affixed thereto are received in the lower recess 53 of the inner member 44 of the bottom rail 32. As can be seen in FIG. 6B, the sealing membrane 90 hangs from the outer end 70 of the anchoring bracket 60 such that the second side 104 of the sealing membrane 90 faces outwardly while the first side 102 faces inwardly. As such, the legs 122 on the second side 104 of the sealing membrane 90 engage the inner surface of the outer vertical wall 57 of the inner member 44 of the bottom rail 32. This engagement of the legs 122 with the inner surface of the outer vertical wall 57 provides a seal between the outer vertical wall 57 and the sealing membrane 90. It is noted that while FIG. 6B illustrates the bypass configuration of the window wall system 50, this same engagement between a window wall module 30 and the anchoring bracket 60 and sealing membrane 90 is present in the balcony configuration as can be seen in FIGS. 16 and 17.

Figure 17:
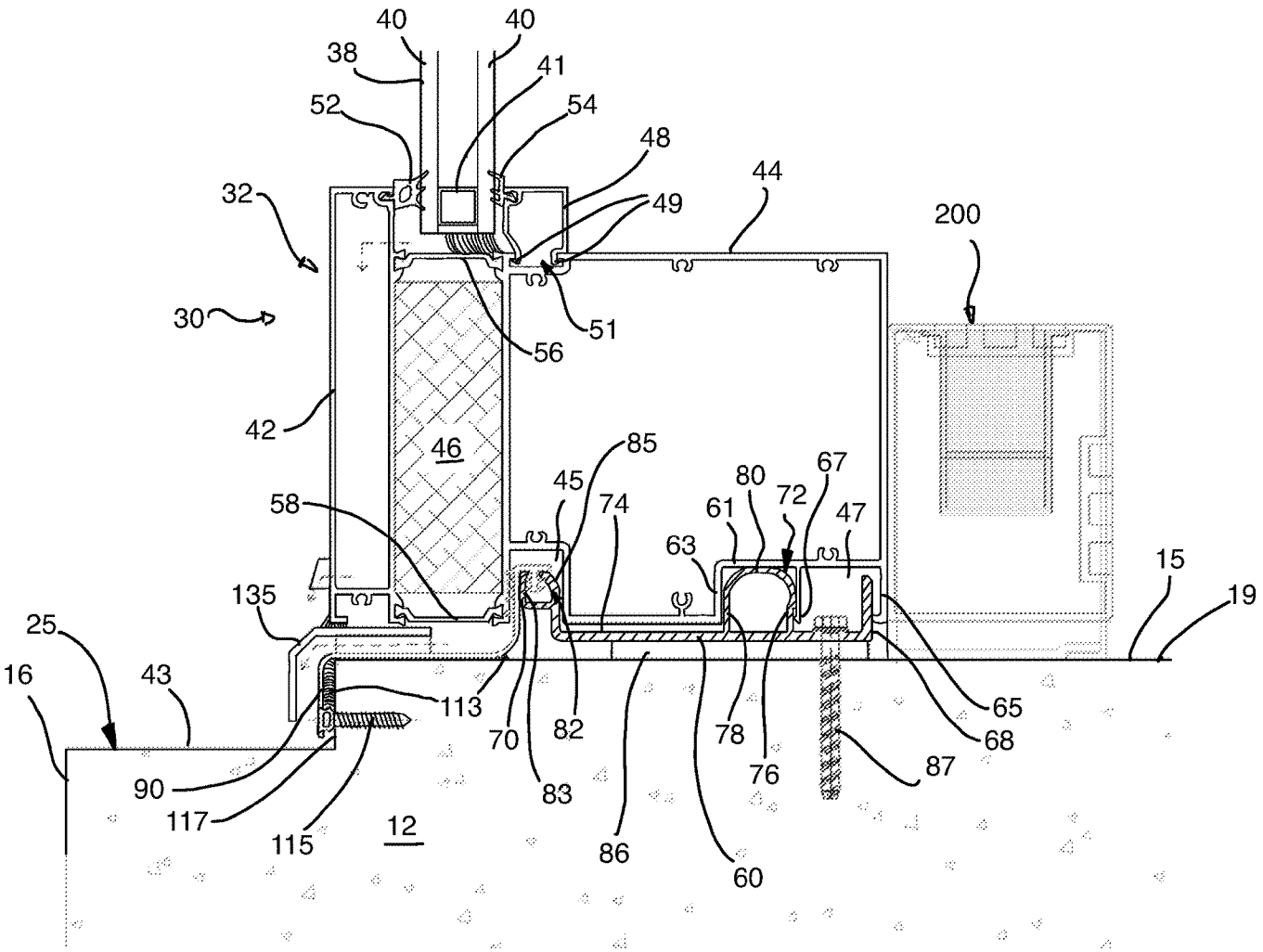
FIG. 17 is a detailed view of a bottom part of the cross-sectional view of FIG. 16.

Furthermore, as can be seen in FIG. 17, in some cases, an optional rail extension 200 can be connected to the inner member 44 of the bottom rail 32. The rail extension 200 can contain electrical elements, such as power outlets for example.

Figure 18:
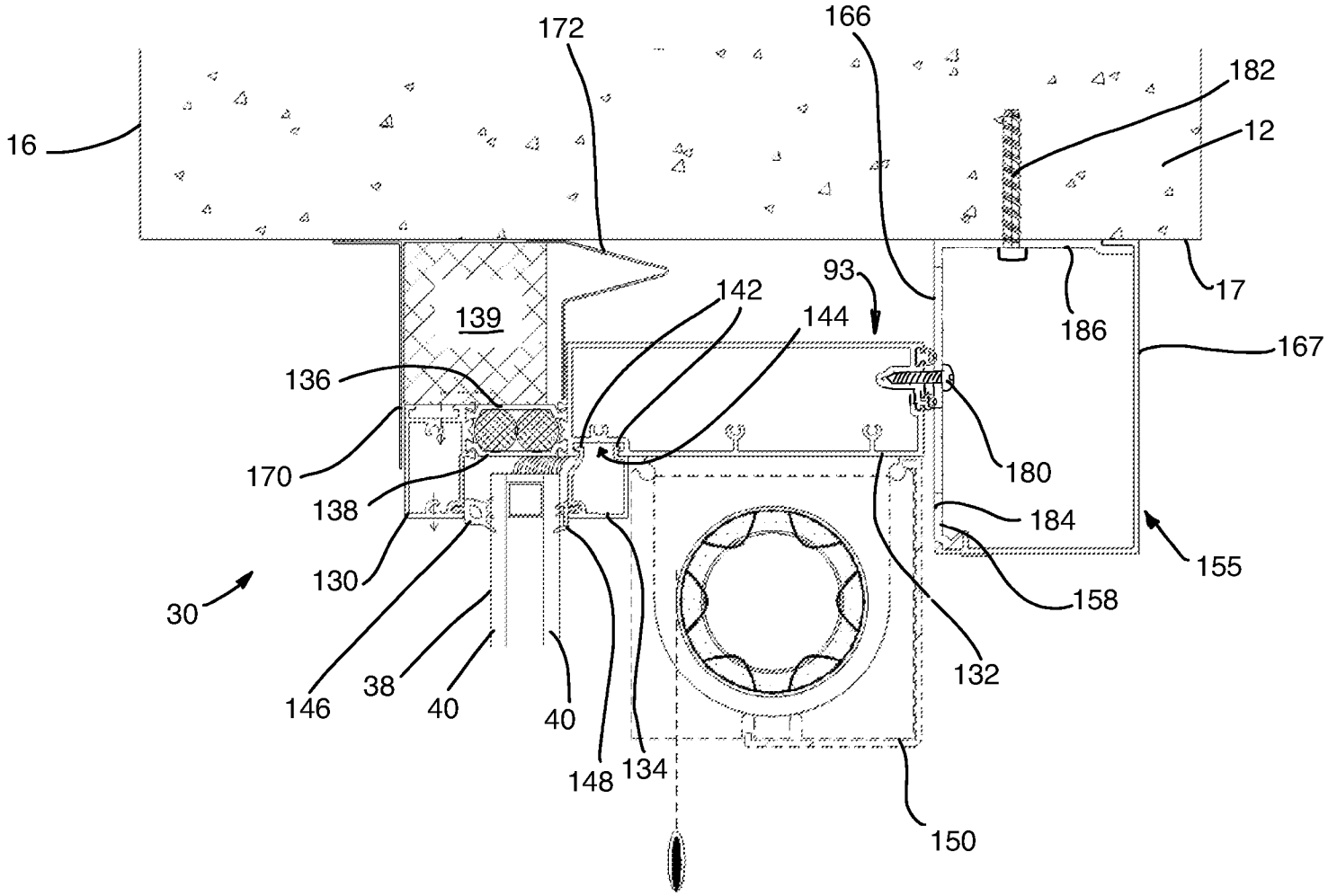
FIG. 18 is a detailed view of a top part of the cross-sectional view of FIG. 17.
Figure 21:
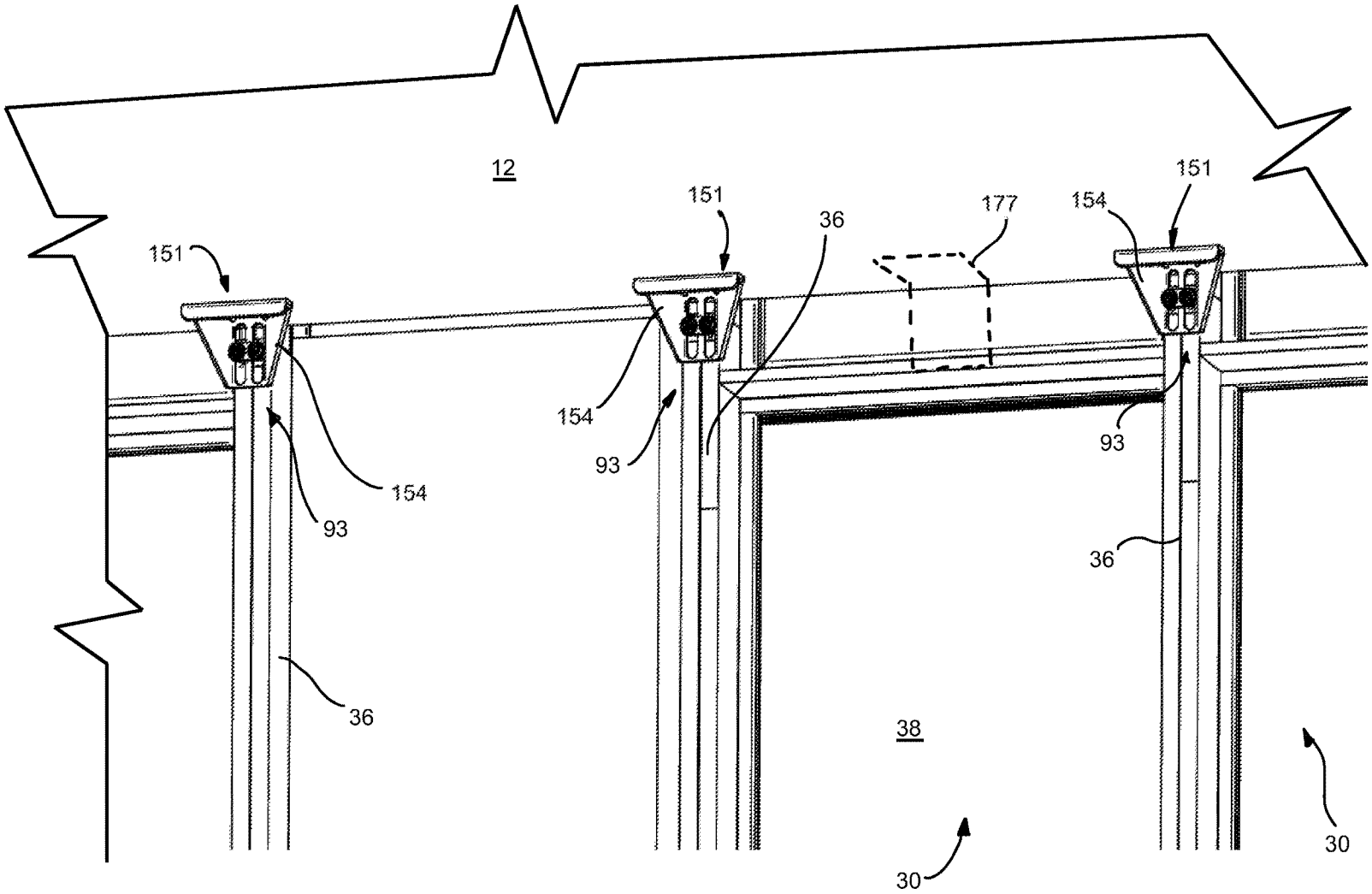
FIG. 21 is a perspective view of the window wall module connected to a top one of the concrete slabs in accordance with another embodiment.

When the bottom rail 32 of the window wall module 30 is properly secured to the anchoring bracket 60, a top portion 93 of the window wall module 30 is then connected to the top concrete slab 12, as shown for example in FIGS. 6C and 18 which illustrate part of the top portion 93 in the bypass and balcony configurations respectively. The top portion 93 of the window wall module 30 includes the parts of the window wall module 30 extending near the upper end of the window wall module 30. For instance, this includes the top rail 34 and the parts of the vertical mullions 36 near the upper end of the window wall module 30. In this embodiment, as can be seen in FIG. 21, two adjustable connectors 151 connect the top portion 93 of each window wall module 30 to the corresponding top concrete slab 12. In particular, in this embodiment, the adjustable connectors 151 connect the vertical mullions 36 to the top concrete slab 12. It is contemplated that, in other embodiments, rather than the vertical mullions 36 being connected to the top concrete slab 12 via the adjustable connectors 151, it may instead be the inner member 132 of the window wall module 30 which is connected to the top concrete slab 12 via the adjustable connectors 151.

Figure 22:
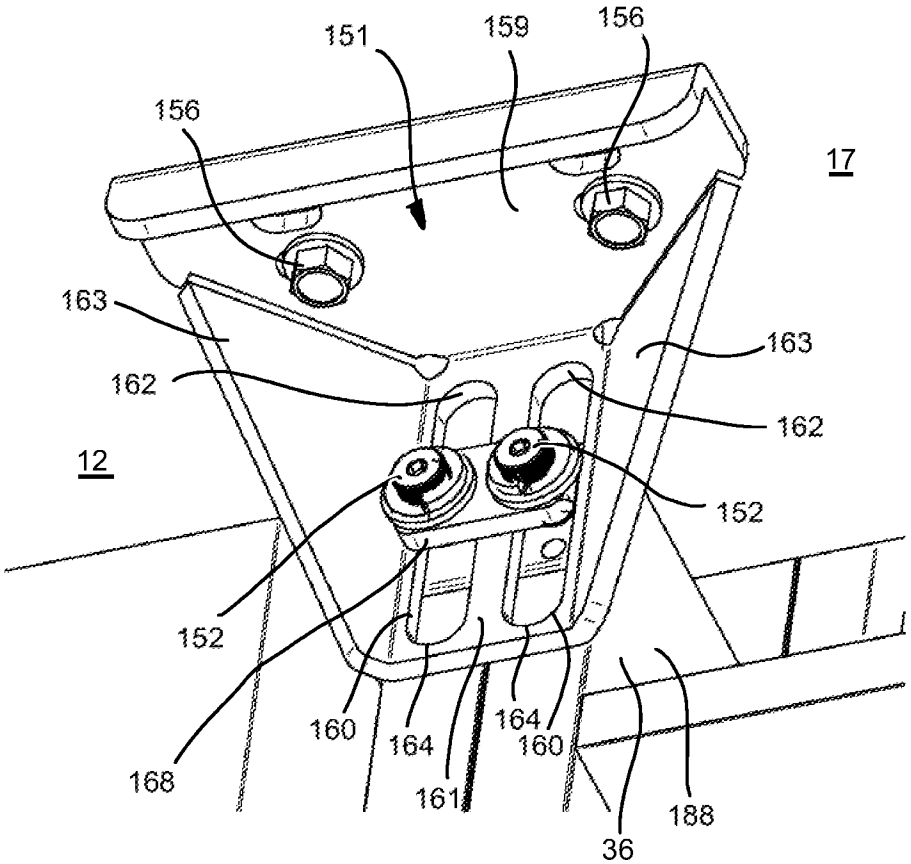
FIG. 22 is a perspective view of an adjustable connector used to connect the window wall module of FIG. 21 to the top one of the concrete slabs.

As shown in FIG. 22, each adjustable connector 151 includes an angle bracket 154 that is connected to two adjacent vertical mullions 36 of two adjacent window wall modules 30 and to the top concrete slab 12. The angle bracket 154 has a top horizontal portion 159 and a bottom vertical portion 161 extending downwardly from the top portion 159. As such, the top and bottom portions 159, 161 are perpendicular to one another. The bottom portion 161 of the angle bracket 154 defines two vertical slots 160, each having an upper end 162 and a lower end 164. The angle bracket 154 also has two lateral flanges 163 extending between the top and bottom portions 159, 161. The lateral flanges 163 are at non-orthogonal angles relative to the bottom portion 161. In particular, in this embodiment, the lateral flanges 163 are oblique relative to the bottom portion 161, namely extend at approximately a 45° angle relative to the bottom portion 161. As will be described in more detail below, this may facilitate installation of the adjustable connectors 151 at corners formed by two window wall modules 30.

In this embodiment, the angle brackets 154 are made of steel so as to support greater loads.

With continued reference to FIG. 22, the angle bracket 154 is fastened to the two adjacent vertical mullions 36 via two fasteners 152 extending through the corresponding slots 160. A spacer 168 is provided between the heads of the fasteners 152 and the bottom portion 161 of the angle bracket 154. The spacer 168 extends across both slots 161. As shown in FIG. 19, the fasteners 152 also extend through respective openings defined by an inner member 188 of each vertical mullion 36. The inner member 188 forms part of two adjacent ones of the vertical mullions 36 and extends rearwardly from an inner face 226 of each of the adjacent vertical mullions 36. A threaded member 189 (e.g., a nut) enclosed within the inner member 188 receives the threaded portion of a corresponding one of the fasteners 152. As will be understood, and as will be explained in greater detail below, the adjustable connectors 151 provide, via the vertical freedom of movement of the fasteners 152 provided by the slots 160 of the angle brackets 154, adjustability of the vertical position of the window wall module 30 relative to the bottom surface 17 of the top concrete slab 12. For its part, the top portion 159 of the angle bracket 154 is fastened by fasteners 156 (e.g., wedge bolts) to a bottom surface 17 of the top concrete slab 12.

Thus, the vertical position of each window wall module 30 relative to the corresponding one of the top concrete slabs 12 is adjustable within a given range as bounded by the upper and lower ends 162, 164 of the slots 160. In some embodiments, the range of adjustments spans between 30 mm and 50 mm. For example, the range of adjustment may span between 35 mm and 45 mm. In this embodiment, the range of the vertical positions spans approximately 38 mm. This range of adjustment of the vertical position of the window wall module 30 relative to the corresponding one of the top concrete slabs 12 allows compensating for manufacturing tolerances of the concrete slabs 12 (e.g., if they're made thicker in some cases) as well as deflection thereof. Notably, in this embodiment, approximately 19 mm of the 38 mm range is provided for compensating for deflection of the concrete slabs 12, and another approximately 19 mm of the 38 mm range is provided for compensating for manufacturing tolerances of the concrete slabs 12.

Figure 23:
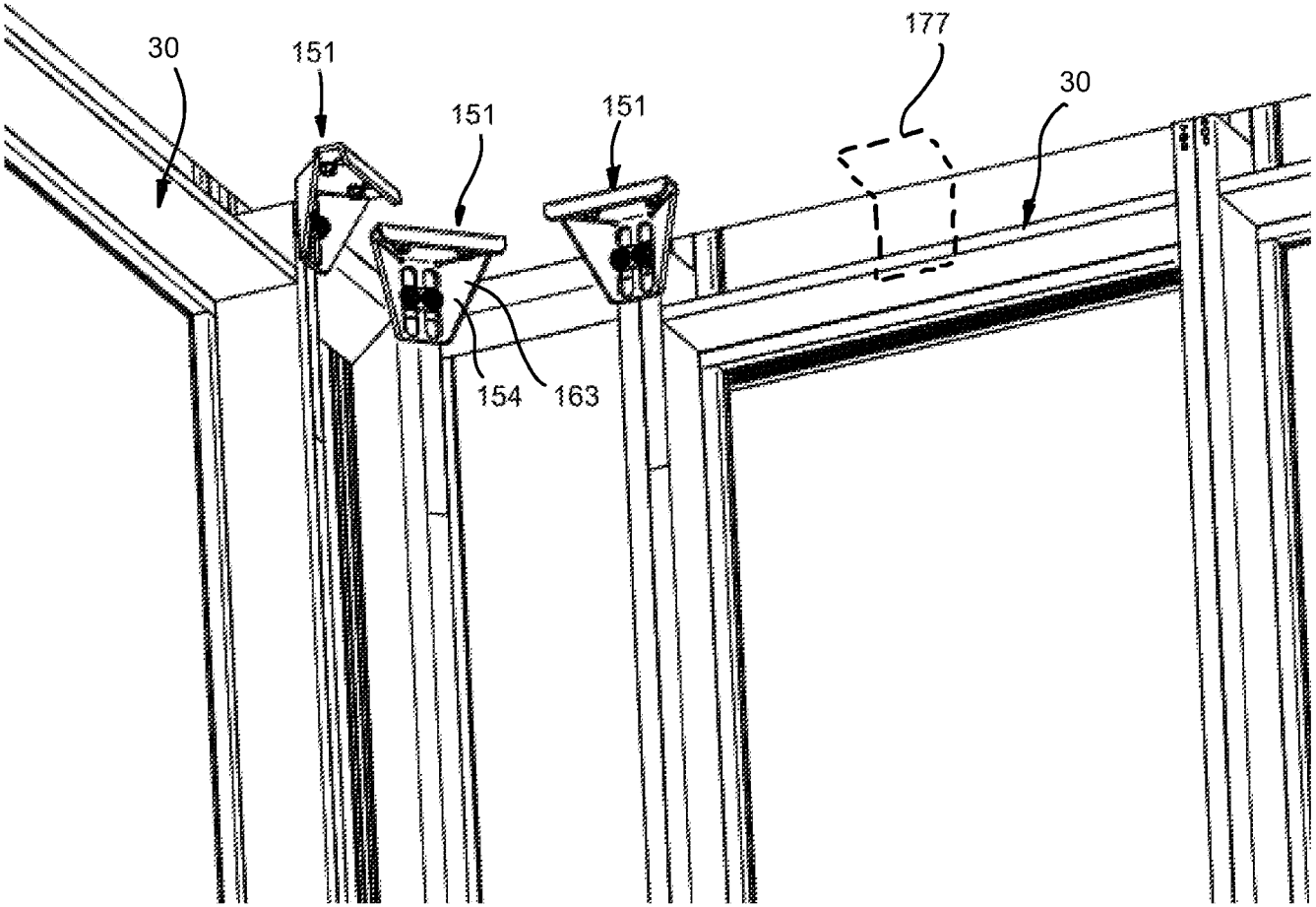
FIG. 23 is a perspective view of the adjustable connector of FIG. 22 used to connect two of the window wall modules forming a corner to the top one of the concrete slabs.

As shown in FIG. 23, the adjustable connectors 151 can be positioned at corners formed between two window wall modules 30 extending perpendicular to one another. Notably, the angle bracket 154 of an adjustable connector 151 is connected to the vertical mullion 36 of a first window wall module 30 and to the vertical mullion 36 of a second window wall module 30. In this embodiment, because the lateral flanges 163 extend at an oblique angle relative to the bottom portion 161 of the angle bracket 154, each lateral flange 163 is generally parallel to the inner surface of the top portion 93 of the respective window wall modules 30 forming the corner. This can facilitate the placement of the adjustable connectors 151 at corners formed by window wall modules 30. As shown in dashed lines FIGS. 21 and 23, in some cases, holding angle brackets 177 may be used to retain the window wall modules 30 affixed to the top concrete slab 12 while the adjustable connectors 151 are installed. The holding angle brackets 177 may be removed once the adjustable connectors 151 are installed.

In some embodiments, as shown in FIG. 18, optional casing units 155 are provided to hide the adjustable connectors 151 from view. In this example of implementation, the casing units 155 extend across multiple ones of the window wall modules 30 located on the same floor of the building 10. Thus, each casing unit 155 hides many of the adjustable connectors 151 from view. Nevertheless, it is contemplated that each casing unit 155 could hide a single one of the adjustable connectors 151 from view.

Each casing unit 155 includes a casing member 158 which is connected to the inner member 132 of the top rail 34 by fasteners 180 (one of which is shown in FIG. 18) and to the bottom surface 17 of the corresponding top concrete slab 12 by fasteners 182 (one of which is shown in FIG. 18). Notably, the casing member 158 is angled, having a top horizontal portion 184 and a bottom vertical portion 186. The bottom portion of the casing member 158 defines vertical slots 166 (one of which is shown in FIG. 18), each slot 166 receiving a corresponding one of the fasteners 180 therein. The connection of the casing member 158 to the top rail 34 via the slots 166 thus does not affect the adjustability provided by the adjustable connectors 151. The top portion 184 of the casing member 158 defines respective openings for receiving the fasteners 182 therein. Where the casing unit 155 overlaps one of the adjustable connectors 151, the bottom portion 186 of the casing member 158 is clamped between the bottom portion 161 of the angle bracket 154 and the inner member 132 of the corresponding top rail 34, while the top portion 184 of the casing member 158 is clamped between the top portion 161 of the angle bracket 154 and the bottom surface 17 of the top concrete slab 12. Each casing unit 155 also includes a cover member 167 affixed to the casing member 158 to hide the corresponding connectors 151, including the fasteners 152 and the angle brackets 154 from view.

As noted above, the casing units 155 are optional and thus, in some embodiments, the casing units 155, including the casing members 158 and the cover members 167, could be omitted such as shown in FIGS. 21 to 23 for example.

Figure 26:
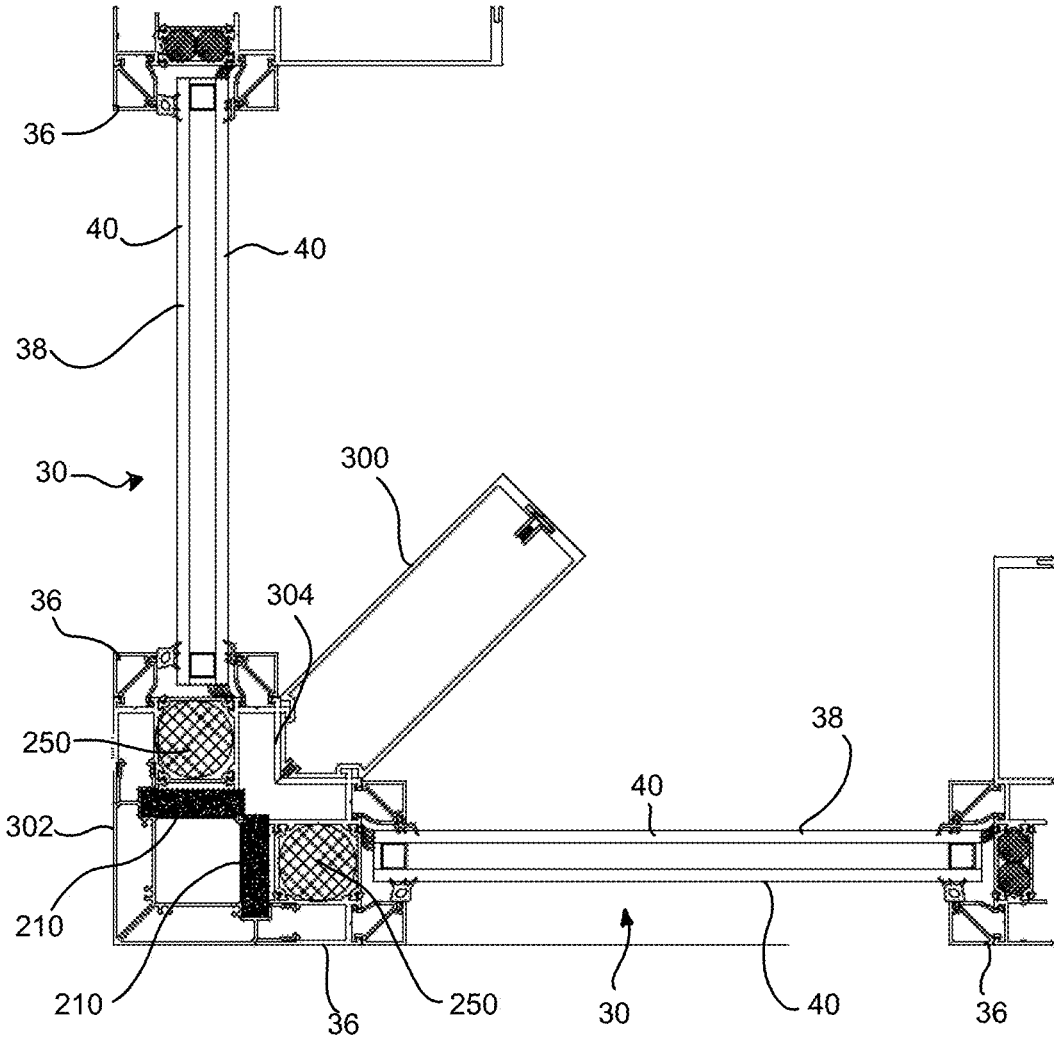
FIG. 26 is a cross-sectional view of two window wall modules connected to one another to form a corner.

In some embodiments, as shown in FIG. 26, two window wall modules 30 perpendicular to one another and forming a corner are connected in part by a corner coupling inner member 300 that forms part of each of the vertical mullions 36 of both window wall modules 30. Notably, the coupling inner member 300 extends inwardly at approximately 45° to the respective planes formed by the panes 40 of the window panels 38 of the two corner window wall modules 30. The vertical mullions 36 of the two corner window wall modules 30 share a common outer corner member 302 and inner corner member 304, each of which has a generally L-shaped cross-sectional profile (the outer corner member 302 having greater dimensions than the inner corner member 304). The outer and inner corner members 302, 304 pinch therebetween two foam inserts 210 that are oriented generally perpendicular to one another. A single insulating member 250 having a circular cross-sectional profile is disposed between the window panel 38 of each window wall module 30 and the respective foam insert 210 disposed at the corner formed by the two adjacent window wall modules 30. The corner coupling inner member 300 is connected (e.g., clipped onto) the inner corner member 304. The coupling inner member 300 may be coupled to the top concrete slab 12 by an adjustable connector 151 in the same manner as described above and shown in FIG. 23. The configuration of the two corner window wall modules 30, including the provision of the corner coupling inner member 300, may allow installing the two corner window wall modules 30 from the inside of the building 10.

Returning now to FIG. 18, the outer member 130 of the top rail 134 is connected to an outer angled sheet 170 which extends upwardly to the bottom surface 17 of the top concrete slab 12. An inner angled sheet 172 is also connected between the outer end of the inner member 132 and the bottom surface 17 of the top concrete slab 12. The outer and inner angled sheets 170, 172 are fastened to the bottom surface 17 of the top concrete slab 12. A fire-resistant insulator 139 is disposed between the outer angled sheet 170 and the inner angled sheet 172. In this example, the insulator 139 is made of rock wool.

As can be seen in FIG. 6C, the connection between the top portion 93 of the window wall module 30 and the top concrete slab 12 is similar in the bypass configuration. However, in the bypass configuration, the top rail 34 extends outwards from the peripheral surface 16 of the concrete slab 12. For instance, part of the inner member 132 extends outwards of the peripheral surface 16 of the top concrete slab 12. As such, in the bypass configuration, there are no sheets 170, 172 present. Rather, the bypass module 20 is disposed atop the top rail 34 as explained above.

Once the top portion 93 of the window wall module 30 is connected to the top concrete slab 12, the window wall module 30 is fixed in place. Next, a second window wall module 30 is installed laterally-adjacent to the first window wall module 30. With reference to FIG. 19 which illustrates a cross-sectional view of some of the laterally-adjacent window wall modules 30 along a horizontal plane, in order to install the second window wall module 30, a foam insert 210 is placed next to the vertical mullion 36 of the first window wall module 30 so that when the second window wall module 30 is installed next to the first window wall module 30, the foam insert 210 is disposed between both window wall modules 30. Then, the second window wall module 30 is put in place, notably its bottom rail 32 is connected to the anchor bracket 60 and its top rail 34 is connected to the top concrete slab 12 in the same manner as described above for the first window wall module 30. The foam insert 210 extends along a majority of the height of the window wall modules 30 (i.e., a majority of the distance between the bottom concrete slab 12 and the top concrete slab 12). The adjacent vertical mullions 36 of the first and second window wall modules 30 pinch the foam insert 210 therebetween at two points 220, 222, which creates two consecutive seals between the adjacent vertical mullions 36 of the first and second window wall modules 30. The outer pinching point 220 is closer to the outer faces 224 of the vertical mullions 36 while the inner pinching point 222 is closer to the inner faces 226 of the vertical mullions 36. The two pinching points 220, 222 are formed by two prongs 228 formed by each vertical mullion 36. The prongs 228 of the adjacent vertical mullions 36 are aligned with one another to form the pinching points 220, 222.

It is noted that the foam insert 210 does not extend outwardly or inwardly from the outer and inner faces 224, 226 of the vertical mullions 36. As such, the foam insert 210 is confined to be contained interiorly between the adjacent vertical mullions 36.

In this embodiment, the foam insert 210 is made of a closed-cell foam, namely ethylene propylene diene monomer (EPDM) foam. It is contemplated that the foam insert 210 could be made of any other suitable material in other embodiments.

The presence of the foam inserts 210 between adjacent ones of the window wall modules 30 creates an efficient seal therebetween. Along with the gaskets extending along the periphery of the window panel 38 and the sealing membrane 90, the foam inserts 210 ensure a sealed window wall system 50. The foam inserts 210 are similarly used at the interface between two window wall modules 30 forming a corner.

Furthermore, as can be seen in FIG. 19, each vertical mullion 36 encloses therein a pair of insulating members 250 having a circular cross-sectional profile. In this embodiment, each insulating member 250 is made of polyethylene foam (e.g., Ethafoam®). It is contemplated that the insulating members 250 may be made of other materials in other embodiments.

Next, the remaining window wall modules 30 of the same floor are installed between the bottom and top concrete slabs 12.

In this embodiment, the window wall modules 30 intended for the bypass configuration come pre-assembled with part of the corresponding bypass module 20 disposed atop the top rails 34 of the window wall modules 30 (see FIG. 3). Notably, the body 22 of the bypass module 20 is already installed on the top rail 34. Thus, as a next step, a cover member 175 (FIG. 6B) of each bypass module 20 is installed atop the bypass body 22. In particular, fasteners 176 affix the cover members 175 to the bypass bodies 22. Furthermore, as can be seen in FIG. 6B, the cover member 175 includes a membrane-receiving portion 179 which defines a recess therein. The membrane-receiving portion 179 is C-shaped. A fire-resistant insulator 149 is then installed atop each corresponding cover member 175. In this example, the insulator 149 is made of rock wool.

In embodiments in which the bypass module 20 has a window panel 29 (top section of FIG. 5), the cover member 175 is disposed atop the top retaining member 33 which, in that embodiment, functions together with the window panel 29 as the bypass body 22.

The installation of the window wall system 50 can then proceed to the next upper floor, where again the anchoring brackets 60 are affixed to the top surface 15 of the corresponding concrete slab 12 in the same way. The sealing membranes 90 are also installed in the same manner, but they can also now be connected to the bypass modules 20 where the sealing membranes 90 are in the bypass configuration. Thus, as shown in FIG. 6B, the interlocking portion 114 of a sealing membrane 90 is inserted into the membrane-receiving portion 179 of the cover member 175. The lips 116, 118 of the interlocking portion 114 help retain the interlocking portion in the C-shaped membrane-receiving portion 179. As can be seen, when the cover member 175 is installed, the membrane-receiving portion 179 thereof is substantially vertically aligned with the membrane-receiving portion 82 of the anchoring bracket 60 above it. As mentioned before, this allows the ends 96, 98 of the sealing membranes 90 in the bypass configuration to remain generally vertically aligned with one another so as to facilitate extending the membranes 90 around corners without resulting in bunched up material of the membranes 90.

The method then proceeds by installing the window wall modules 30 as described above in the same manner, and repeating the same steps for each floor of the building 10.

The above-described method for installing the window wall modules 30 is time-efficient and can be performed without requiring access from the exterior of the building 10. That is, the whole installation of the anchoring brackets 60, membranes 90 and window wall modules 30 is done from the inside by personnel on the concrete slabs 12. This is advantageous compared to certain systems which must be installed from the outside (e.g., curtain wall systems) and thus require cranes or other machinery disposed at the exterior of the building in order to perform the installation. In addition, as discussed above, the window wall system 50 installed according to this method provides greater sealing performance than conventional solutions.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A window wall system for a building, the building comprising a plurality of vertically spaced concrete slabs forming respective floors of the building, the window wall system comprising:

a plurality of window wall modules for forming at least in part a facade of the building, each of the window wall modules of the plurality of window wall modules being connected between two consecutive ones of the concrete slabs, each of the window wall modules comprising:

a bottom rail configured to be connected to a bottom one of the two consecutive concrete slabs;

a top rail extending generally parallel to the bottom rail;

two vertical mullions connected between the bottom and top rails; and a window panel retained between the bottom rail, the top rail and the two vertical mullions;

a plurality of anchoring brackets for connecting the bottom rail of each window wall module to a respective one of the concrete slabs, each anchoring bracket being configured to be affixed to a top surface of the respective one of the concrete slabs, each anchoring bracket comprising a membrane-receiving portion defining a recess; and a plurality of preformed sealing membranes, each sealing membrane sealingly engaging the bottom rail of a corresponding window wall module, each sealing membrane comprising an interlocking feature that is inserted into the recess of a respective one of the anchoring brackets so that the interlocking feature collaborates with the membrane-receiving portion of the respective one of the anchoring brackets to prevent the sealing membrane from disengaging the membrane-receiving portion and thereby retain the sealing membrane in place, each sealing membrane being made of an elastomeric material.

2. The window wall system of claim 1, wherein:

the building has at least one balcony area, each of the at least one balcony area being formed in part by a given one of the concrete slabs having:

a stepped portion having a top surface; and an upper portion at least partly surrounding the stepped portion, the upper portion having a top surface disposed vertically higher than the top surface of the stepped portion;

at least one of the anchoring brackets is configured to be affixed to the top surface of the upper portion of each given one of the concrete slabs near an edge of the stepped portion thereof; and the plurality of sealing membranes includes at least one balcony sealing membrane configured to prevent passage of fluid between (i) the bottom rail of at least one of the window wall modules connected to the at least one of the anchoring brackets and (ii) the given one of the concrete slabs, each of the at least one balcony sealing membrane being interlocked with the at least one of the anchoring brackets, part of each of the at least one balcony sealing membrane being configured to be bent about an edge of the upper portion of the given one of the concrete slabs and fastened to a vertical surface of the given one of the concrete slabs extending between the stepped portion and the upper portion.

3. The window wall system of claim 2, wherein:

the window wall system further comprises a plurality of bypass modules for forming at least in part the facade of the building, each of the bypass modules being connected between the top rail of a first one of the window wall modules and a bottom rail of a second one of the window wall modules disposed vertically above the first one of the window wall modules;

each of the bypass modules comprises:

a bypass body; and a cover member disposed atop the bypass body;

the plurality of sealing membranes includes at least one bypass sealing membrane configured to prevent passage of fluid between (i) the bottom rail of at least one of the window wall modules and (ii) the cover member of at least one of the bypass modules; and the at least one bypass sealing membrane and the at least one balcony sealing membrane having identical cross-sectional profiles.

4. The window wall system of claim 1, wherein:

the window wall system further comprises a plurality of bypass modules forming at least in part the facade of the building, each of the bypass modules being connected between the top rail of a first one of the window wall modules and a bottom rail of a second one of the window wall modules disposed vertically above the first one of the window wall modules;

each bypass module comprises:

a bypass body; and a cover member disposed atop the bypass body;

and the plurality of sealing membranes includes at least one bypass sealing membrane configured to prevent passage of fluid between (i) the bottom rail of at least one of the window wall modules and (ii) the cover member of at least one of the bypass modules.

5. The window wall system of claim 4, wherein:

each of the bypass sealing membranes has an upper end and a lower end; and the upper end and the lower end of each of the bypass sealing membranes are generally aligned with one another so that the upper end is positioned vertically above the lower end.

6. The window wall system of claim 5, wherein, for each of the bypass sealing membranes:

the interlocking feature of the bypass sealing membrane is disposed at upper end thereof for interlocking the bypass sealing membrane with a corresponding anchoring bracket; and the lower end has a second interlocking feature for interlocking the bypass sealing membrane with a corresponding bypass module.

7. The window wall system of claim 1, wherein each of the sealing membranes has a plurality of legs for engaging a surface of the bottom rail of the respective one of the window wall modules.

8. The window wall system of claim 1, wherein each of the sealing membranes is made of silicone.

9. The window wall system of claim 1, wherein each of the sealing membranes is configured to be distanced from a peripheral edge of a corresponding one of the concrete slabs.

10. The window wall system of claim 1, further comprising a plurality of foam inserts disposed between laterally-adjacent ones of the window wall modules to prevent entry of fluid therebetween, each of the foam inserts being pinched at least at two points by the respective vertical mullions of the laterally-adjacent ones of the window wall modules, including a first point and a second point, wherein the second point is closer to an inner face of each of the vertical mullions of the laterally-adjacent ones of the window wall modules than the first point.

* * * * *